US010655640B1

(12) United States Patent
Dickinson et al.

(10) Patent No.: US 10,655,640 B1
(45) Date of Patent: May 19, 2020

(54) DOUBLE INLET CENTRIFUGAL BLOWER WITH PCB CENTER PLATE

(71) Applicant: LTI Holdings, Inc., Modesto, CA (US)

(72) Inventors: Roger Dickinson, Torrington, CT (US); John O'Connor, New Hartford, CT (US)

(73) Assignee: LTI HOLDINGS, INC., Modesto, CA (US)

( * ) Notice: Subject to any disclaimer, the term of this patent is extended or adjusted under 35 U.S.C. 154(b) by 496 days.

(21) Appl. No.: 14/863,085

(22) Filed: Sep. 23, 2015

Related U.S. Application Data

(63) Continuation-in-part of application No. 13/277,269, filed on Oct. 20, 2011, now Pat. No. 9,157,441.

(51) Int. Cl.

| | |
|---|---|
| ***F04D 29/66*** | (2006.01) |
| ***F04D 17/08*** | (2006.01) |
| ***F04D 25/06*** | (2006.01) |
| ***F04D 29/28*** | (2006.01) |
| ***F04D 29/42*** | (2006.01) |
| ***F04D 29/053*** | (2006.01) |
| ***F04D 29/056*** | (2006.01) |
| ***F04D 17/10*** | (2006.01) |

(52) U.S. Cl.
CPC ..... *F04D 29/663* (2013.01); *F04D 17/08* (2013.01); *F04D 17/105* (2013.01); *F04D 25/06* (2013.01); *F04D 29/053* (2013.01); *F04D 29/056* (2013.01); *F04D 29/281* (2013.01); *F04D 29/4206* (2013.01)

(58) Field of Classification Search
CPC .... F04D 29/663; F04D 29/056; F04D 29/053; F04D 29/4206; F04D 29/281; F04D 25/06; F04D 17/08; F04D 17/105; H02K 3/48; H02K 3/487
See application file for complete search history.

(56) References Cited

U.S. PATENT DOCUMENTS

| | | | |
|---|---|---|---|
| 2,776,088 | A | 1/1957 | Wentling |
| 3,231,176 | A | 1/1966 | Bowen |
| 3,480,202 | A | 11/1969 | Stephenson, Jr. |
| 3,775,029 | A | 11/1973 | Ranz |
| 5,257,904 | A | 11/1993 | Sullivan |

(Continued)

FOREIGN PATENT DOCUMENTS

| | | |
|---|---|---|
| CN | 2627252 Y | 7/2004 |
| GB | 140664 | 4/1920 |

(Continued)

OTHER PUBLICATIONS

Torin Airflow Management, Direct Drive Blowers (10, 2004), www.torin.com.au/PDF/04_TorinDirectDriveBlowers_201110.pdf.

(Continued)

*Primary Examiner* — Devon C Kramer
*Assistant Examiner* — Christopher J Brunjes
(74) *Attorney, Agent, or Firm* — Ice Miller LLP

(57) ABSTRACT

A centrifugal blower apparatus includes a scroll-shaped housing with first and second air inlets which open to a blower chamber that is in fluid communication with an air outlet. The blower includes a motor to drive impellers, wherein the motor is secured to a frame coupled within the housing in a manner to substantially enhance aerodynamic performance of the blower.

20 Claims, 27 Drawing Sheets

(56) References Cited

U.S. PATENT DOCUMENTS

| | | | | |
|---|---|---|---|---|
| 5,570,996 | A | 11/1996 | Smiley, III | |
| 5,592,059 | A | 1/1997 | Archer | |
| 5,925,948 | A | 7/1999 | Matsumoto | |
| 6,030,173 | A * | 2/2000 | Bacchiocchi | F04D 17/105 415/102 |
| 6,076,795 | A | 6/2000 | Scheidel et al. | |
| 7,112,910 | B2 | 9/2006 | Lopatinsky et al. | |
| 7,167,364 | B2 | 1/2007 | Lopatinsky et al. | |
| 8,100,637 | B2 | 1/2012 | Sinzaki | |
| 2005/0140233 | A1* | 6/2005 | Kojima | F04D 25/0653 310/156.37 |
| 2008/0001488 | A1 | 1/2008 | Pyrhonen et al. | |
| 2009/0114206 | A1 | 5/2009 | Post | |
| 2010/0044468 | A1* | 2/2010 | Granger | F04D 25/02 239/304 |
| 2010/0089090 | A1 | 4/2010 | Kim et al. | |
| 2010/0101841 | A1* | 4/2010 | Fan | H05K 1/0218 174/257 |
| 2010/0226802 | A1* | 9/2010 | Kawamura | H02K 16/02 417/423.7 |
| 2011/0156526 | A1* | 6/2011 | Lau | H02K 9/06 310/216.129 |
| 2011/0243720 | A1 | 10/2011 | Post | |
| 2011/0308777 | A1* | 12/2011 | O'Connor | F04D 17/16 165/121 |
| 2012/0051904 | A1* | 3/2012 | Hagen | A62B 18/006 415/224 |
| 2013/0216410 | A1 | 8/2013 | Patterson et al. | |

FOREIGN PATENT DOCUMENTS

| | | |
|---|---|---|
| GB | 733533 | 7/1955 |
| KR | 20070050155 A | 5/2007 |
| WO | 2012012547 A1 | 1/2012 |

OTHER PUBLICATIONS

Fasco, Stock Replacement Catalogue, p. 60-65. (2008). www.fasco.com/prodcat.asp.

* cited by examiner

DOUBLE INLET CENTRIFUGAL BLOWER WITH PCB CENTER PLATE

CROSS-REFERENCE TO RELATED APPLICATIONS

The present application claims priority to U.S. patent application Ser. No. 13/277,269, filed on Oct. 20, 2011, and U.S. patent application Ser. No. 13/656,227 filed on Oct. 19, 2012, the applications of which is incorporated herein by reference in its entirety.

FEDERAL SPONSORSHIP

Not Applicable

JOINT RESEARCH AGREEMENT

Not Applicable

TECHNICAL FIELD

The present invention relates generally to centrifugal blowers, and more particularly relates to a double inlet centrifugal blower a drive motor integrated into the double inlet housing wherein the drive motor minimizes interference with air flow dynamics through the blower to enhance efficiency and reduce acoustic levels.

BACKGROUND

Demands for electronic equipment to increasingly provide higher-performance operation in smaller packages are ever present. Typically, such electronic equipment requires compact and highly efficient cooling systems to provide cooling air to power supplies, microprocessors, and related electronics that reside in the equipment. A typical cooling system involves one or more blowers for moving air across one or more operating electronic components, such as printed circuit boards.

The flow path layout, type of air moving device, and how well it is integrated into the system are each key elements in achieving desired cooling performance in a small package size. Air movers of various types are available to select from when designing an electronics package cooling system. The available air mover types include axial fans and centrifugal blowers, each exhibiting advantages and disadvantages.

Conventional systems, however, often employ fans and blowers that are not well matched to the system pressures, or do not move air efficiently within the space constraints, and therefore result in unacceptable noise and relatively large power consumption. A particularly useful type of air mover is a double inlet centrifugal blower. Such blowers may be particularly well suited for restrictive flow systems that require a high volume of cooling air. Conventional implementations of centrifugal blowers typically employ a motor that is affixed in one of two inlets, or inside the hub of the blower wheel with strut connections at one or both of the inlets.

Neither conventional centrifugal blower design is optimal, because the motor occupies valuable aerodynamic space, reducing the overall cooling efficiency of the blower, and creating unwanted noise. Also, the hub motor approach may require a hollow shaft and resultant manufacturing complexities associated with routing stator wires through a mounting shaft. A marketplace example of a conventional arrangement in which the motor is mounted in one of the two air inlets of the centrifugal blower is available from Fasco as model number B45267. An example of a double inlet centrifugal blower with a hub motor with a strut assembly for securing the motor inside of the hub is described in U.S. Pat. No. 2,776,088 to Wentling.

An alternate approach employs a mid-plane blower motor of the type described in U.S. Pat. No. 3,231,176 to Bowen. While the arrangement described in the Bowen '176 patent reduces the obstruction to the impeller, such design nevertheless employs struts for rotor support in the housing inlets. Such struts, as recognized above, inhibit aerodynamic efficiency.

The present invention provides a double inlet centrifugal blower employing a motor which minimizes aerodynamic interference and simplifies construction. In doing so, such a blower enhances operating efficiency to potentially reduce power consumption and noise output.

SUMMARY

In accordance with embodiments of the present invention, the operating efficiency of a double inlet centrifugal blower may be significantly enhanced while simultaneously reducing noise output. Moreover, the arrangement of the present invention reduces manufacturing costs, and simplifies assembly.

In one embodiment, a centrifugal blower apparatus of the present invention includes a dual inlet housing having scroll-shaped sides, wherein the inlets open to a blower chamber that is in fluid communication with an air outlet of the housing. The blower apparatus further includes an operating system having a continuous, solid frame and motor arranged in the blower chamber between the sides. The portion of the motor components are secured to the frame. The frame includes a hub defining a blower axis and the motor includes a stator and a rotor that is rotatably driven about the blower axis. The rotor includes an impeller portion including impeller blades for motivating air from the air inlet, through the blower chamber, and out the air outlet. The operating system is coupled with the housing away from the inlets of the blower housing.

In another embodiment, the centrifugal blower apparatus of the present invention includes a housing having scroll-shaped sides, wherein the sides have corresponding air inlets. The air inlets open to a blower chamber that is in fluid communication with an air outlet. The housing may include two housing sections divided substantially mid-way between the sides. The blower apparatus further includes an operating system having a frame arranged in the blower chamber between the sides, at least one impeller for motivating air out from the blower chamber through the air outlet, and a motor for rotating the impeller about a hub.

The motor has a rotor coupled to the impeller and an annular stator arranged radially outwardly about the rotor. The rotor and stator are engaged to the frame within the blower chamber. The continuous frame may divide the interior of the blower housing into two distinct chambers or may include relief apertures to allow air to flow between opposing sides of the frame and interior of the housing. The operating system is coupled within the housing away from the housing inlets.

In another embodiment, the centrifugal blower apparatus of the present invention includes a housing, a motor support, first and second impellers, a spindle and a motor. The housing has air inlets formed in opposing sides of the housing and the housing has an air outlet formed in an open end of the housing. The air inlets and air outlet are in fluid communication with a blower chamber within the housing. The motor support divides the blower chamber into at least a first and second sub-chamber, wherein the motor support isolates the first sub-chamber from fluid communication with the second sub-chamber. Further, each air inlet is separately in fluid communication with the air outlet. The motor support has apertures formed through a central portion of the motor support and the apertures are adapted to receive a motor support sleeve. The first impeller is positioned in the first sub chamber and motivates air from the corresponding inlet to the outlet and the second impeller is positioned in the second sub chamber and motivates air from the corresponding inlet through the second sub chamber to the outlet. The spindle has a first end portion attached to the first impeller and a second end portion is attached to the second impeller.

The motor support sleeve includes a spindle hub that has bearings to rotationally support the spindle. The motor rotates the first and second impellers. The motor has a rotor fixed to the spindle and a stator fixed to the motor support sleeve, such that an inner circumference of the stator is arranged concentrically radially about an outer circumference of the rotor, wherein the inner circumference of the stator is slightly larger than the outer circumference of the rotor. In an embodiment of the invention at least a portion of the motor support consists of a printed circuit board. A portion of the printed circuit board extends beyond an exterior of the housing. Further, a single elongated printed circuit may be incorporated into multiple centrifugal blowers to thereby create an array of blowers and couple the blowers together. Those skilled in the art will appreciate that the array is particularly well suited to be incorporated into a divided tray module.

In another embodiment of the invention the centrifugal blower apparatus of the present invention includes a housing, motor support frame, first and second impellers, and a motor. The housing has air inlets formed in opposing sides of the housing and has an air outlet formed in an open end of the housing. The air inlets and air outlet are in fluid communication with a blower chamber within the housing. The motor support frame may divide the blower chamber into at least first and second sub-chambers, wherein the motor support frame isolates the first sub-chamber from fluid communication with the second sub-chamber and further wherein each air inlet is separately in fluid communication with the air outlet. The first impeller motivating air in the first sub-chamber and the second impeller motivates air positioned in the second sub-chamber. The first and second impellers rotate about a concentric axes of rotation.

The motor rotates the first and second impellers via a rotor and stator, The rotor, first and second impellers, and second impeller are all spaced apart and coupled along an elongated shaft. The motor shaft is supported by bearings coupled to the motor support frame and the stator is also fixed to the motor support frame. The inner circumference of the stator is arranged concentrically radially about an outer circumference of the rotor, wherein the inner circumference of the stator is slightly larger than the outer circumference of the rotor.

In another embodiment of the centrifugal blower of the present invention the blower includes a housing, printed circuit board motor support, first and second impellers, spindle and motor. The housing has air inlets formed in opposing sides of the housing and has an air outlet formed in an open end of the housing, wherein the air inlets and the air outlet are in fluid communication with a blower chamber within the housing. The motor support consists of a printed circuit board that divides the blower chamber into at least a first and second sub-chamber, wherein the motor support isolates the first sub-chamber from fluid communication with the second sub-chamber. The first impeller motivates air within the first sub-chamber and the second impeller motivates air positioned in the second sub-chamber. The spindle extends through the motor support and has a first end portion attached to the first impeller and a second end portion attached to the second impeller. The motor rotates the first and second impellers via a rotor fixed to the spindle and a stator fixed to the motor support. An inner circumference of the stator is arranged concentrically radially about an outer circumference of the rotor, wherein the inner circumference of the stator is slightly larger than the outer circumference of the rotor.

The motor support may include an adapter to affix the stator to the motor support. Further the motor support may have apertures formed through a central portion of the motor support and the apertures may be adapted to receive an adapter. A portion of the printed circuit board may extend beyond an exterior of the housing. Further, multiple centrifugal blowers may be joined together by a single motor support common to all centrifugal blowers. A spindle hub may be attached to the motor support, wherein the hub has bearings to rotationally support the spindle. The adapter may further include a spindle hub having bearings to rotationally support the spindle.

The accompanying drawings, which are incorporated in and constitute a portion of this specification, illustrate embodiments of the invention and, together with the detailed description, serve to further explain the invention. The embodiments illustrated herein are presently preferred; however, it should be understood, that the invention is not limited to the precise arrangements and instrumentalities shown. For a fuller understanding of the nature and advantages of the invention, reference should be made to the detailed description in conjunction with the accompanying drawings.

DESCRIPTION OF THE DRAWINGS

In the various figures, which are not necessarily drawn to scale, like numerals throughout the figures identify substantially similar components.

DETAILED DESCRIPTION

The following description provides detail of various embodiments of the invention, one or more examples of which are set forth below. Each of these embodiments are provided by way of explanation of the invention, and not intended to be an undue limitation of the invention. Further, those skilled in the art will appreciate that various modifications and variations may be made in the present invention without departing from the scope or spirit of the invention. By way of example, those skilled in the art will recognize that features illustrated or described as part of one embodiment, may be used in another embodiment to yield a still further embodiment. Thus, it is intended that the present invention also cover such modifications and variations that come within the scope of the appended claims and their equivalents.

Figure 1:
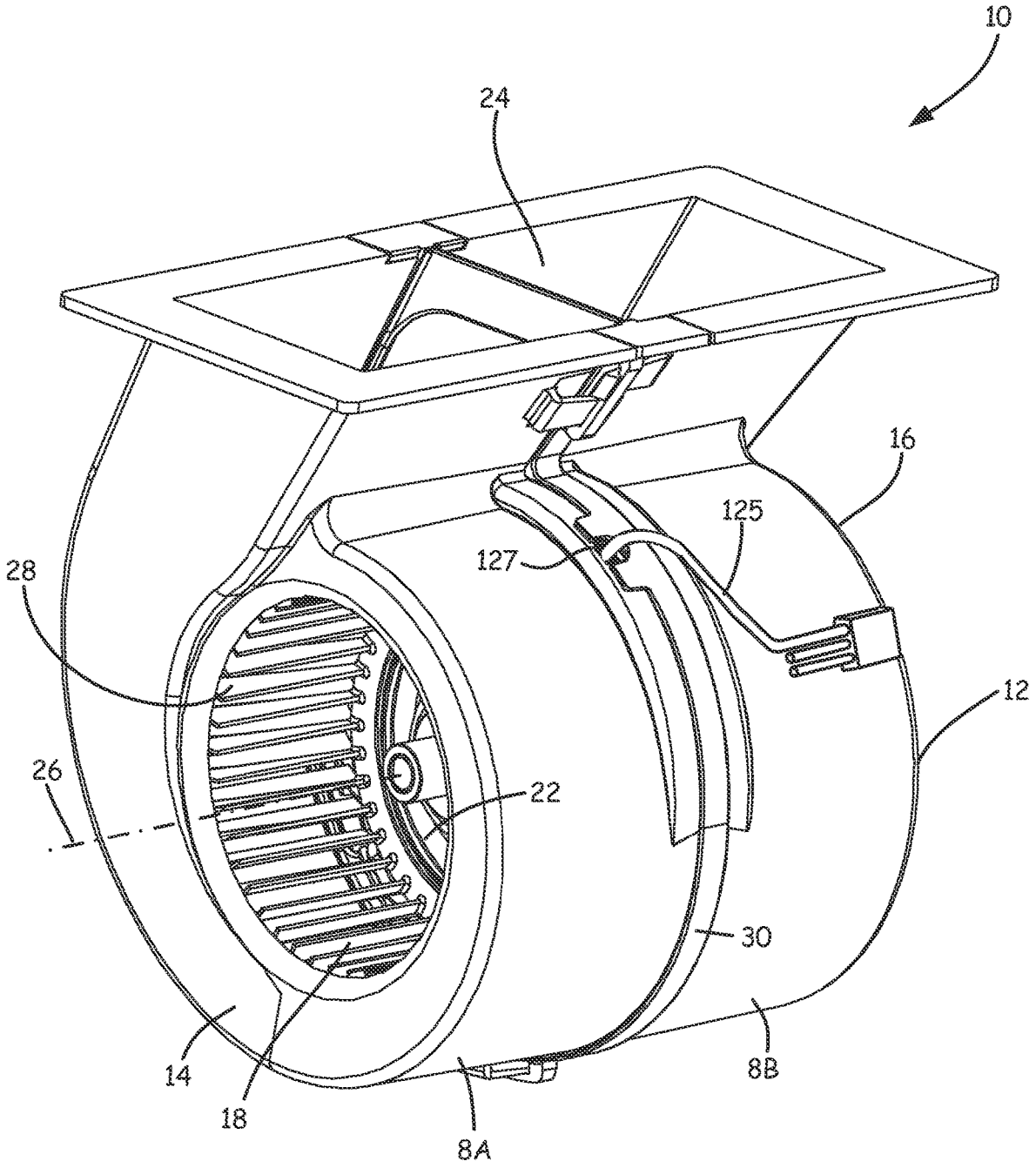
FIG. 1 is a perspective view of an embodiment of the centrifugal blower of the present invention.
Figure 2:
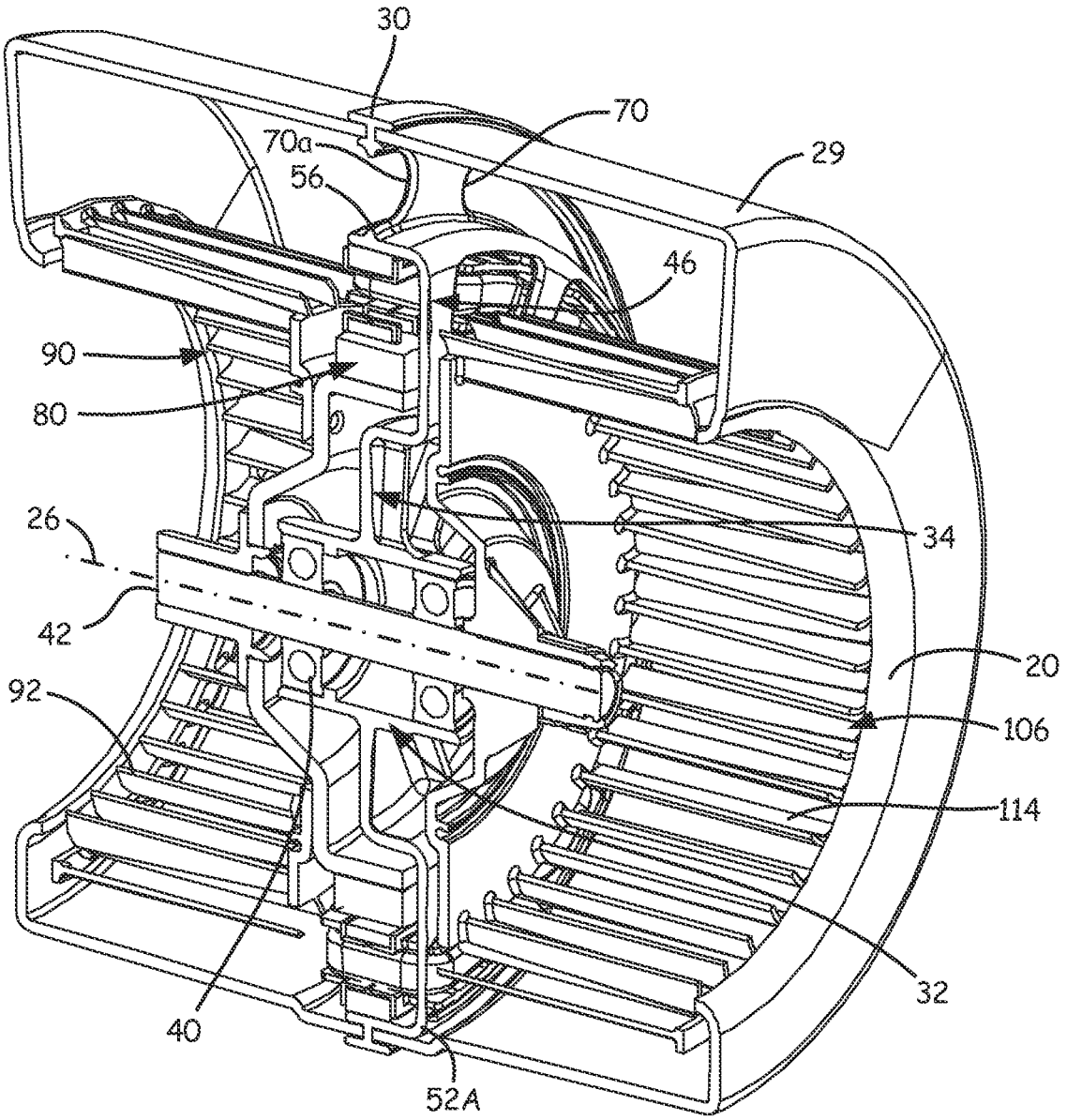
FIG. 2 is a cross-sectional perspective view of the blower illustrated in FIG. 3.

With reference now to the drawings, and first to FIGS. 1-2, a centrifugal blower apparatus 10 includes a housing 12 having a first scroll-shaped side 14 with a first air inlet 18, and a second scroll-shaped side 16 with a second air inlet 20. First and second air inlets 18, 20 open to a blower chamber 22 that is in fluid communication with an air outlet 24 of housing 12. It is contemplated that housing 12 may be configured as needed, including in a generally conventional configuration employing an expanding scroll-shape in the output air flow portion of housing 12.

Blower apparatus 10 may preferably be a centrifugal blower in which air flowing into first and second inlets 18, 20 substantially parallel to a blower inlet axis 26 may be re-directed radially of blower axis 26 by an impeller 28 rotating about blower axis 26. In a particular embodiment, blower apparatus 10 may be a "double-inlet" centrifugal blower employing first and second inlets 18, 20 at opposed first and second sides 14, 16. Moreover, blower apparatus 10 may be a double width, double inlet (DWDI) blower of the type illustrated. As indicated above, certain applications favor the utilization of a centrifugal blower, and may, in some cases, preferably employ a double inlet centrifugal blower.

The illustrated embodiment of housing 12 employs first and second housing sections 8A, 8B which are secured together at a coupling location 30, as will be described in greater detail herein below. The coupling of first and second housing sections 8A and 8B establishes blowing chamber 22 and a defined air outlet 24. It is to be understood, however, that housing 12 may be fabricated in one or more sections/pieces, and may be assembled in a manner suitable for the desired application. In the illustrated embodiment, first and second housing sections 8A, 8B are substantially mirror images securable at coupling location 30, which may be substantially mid-way between first and second sides 14, 16. Coupling location 30 may therefore be disposed at a mid-portion 33 of housing 12. It is to be understood that housing 12 may be fabricated from a variety of materials encompassing numerous physical properties. Housing 12 may therefore be fabricated from metals, plastics, composites, ceramics, and the like.

An operating system or subassembly 32 includes the rotating and stationary components of the air moving equipment of blower apparatus 10 in a manner that is substantially less aerodynamically intrusive than conventional approaches. Moreover, operating system 32 facilitates precise and stable support of moving components relative to stationary components, thereby allowing close operating clearances and higher motor efficiencies to compliment the aerodynamic efficiency described above.

Operating system 32 includes a frame 34 that is arranged in blower chamber 22 between first and second sides 14, 16. Frame 34 may be a unitary cast member or an assembly which provides the structural support of blower apparatus 10. Consequently, frame 34 is preferably sufficiently strong to stably support the remaining components of blower apparatus 10 in precise and stable relative operating positions. A consequence of such stability is the opportunity for a fabricator to minimize the separation distance or clearance between components to further enhance the operating efficiencies of blower apparatus 10. Frame 34 may therefore be fabricated from a strong and relatively rigid material such as appropriate metals, plastics, composites, and ceramics. In one embodiment, frame 34 is a unitary cast body that is cast as a single piece from aluminum, or may be an injection molded engineered plastic.

In the embodiment illustrated in FIGS. 1-7, frame 34 includes a bearing housing portion 36 that may be integrally formed with frame 34 to form a bearing chamber 38 in which one or more bearings 40, such as ring bearings, may be operably positioned. Such bearings 40 rotatably engage and support a shaft 42 within a hub 44. Shaft 42 is therefore arranged in hub 44 to rotate about blower axis 26. Shaft 42 is therefore rotatably engaged or secured to frame 34 through one or more bearings 40, which are themselves secured or engaged in bearing chamber 38 defined by bearing housing portion 36 of frame 34.

Frame 34 may include a stator support portion 46 that extends radially outwardly from central portion 48 of frame 34. In some embodiments, central portion 48 is coextensive with a midplane 50 that extends substantially perpendicularly to blower axis 26 through midportion 33 of housing 12. Stator support portion 46 of frame 34 may include an upright portion 52 axially offset from central portion 48 to form a mounting pocket between central portion 48, upright portion 52, and upper brace portion 56 of frame 34. Upper brace portion 56 may extend from upright portion 52 in a direction substantially parallel to blower axis 26, and may further include a strengthening rib 58 for strengthening and inhibiting deflection of upper brace portion 56 in the operation of blower apparatus 10. The extent of axial displacement of upright portion 52 from central portion 48 of frame 34 may preferably be sufficient to define a mounting pocket of adequate axial width to facilitate mounting of rotor and stator elements substantially along midplane 50. It is contemplated, however, that frame 34 may be provided in a configuration without a mounting pocket, with the illustrated embodiment defining merely an exemplary embodiment of the present invention.

Figure 11:
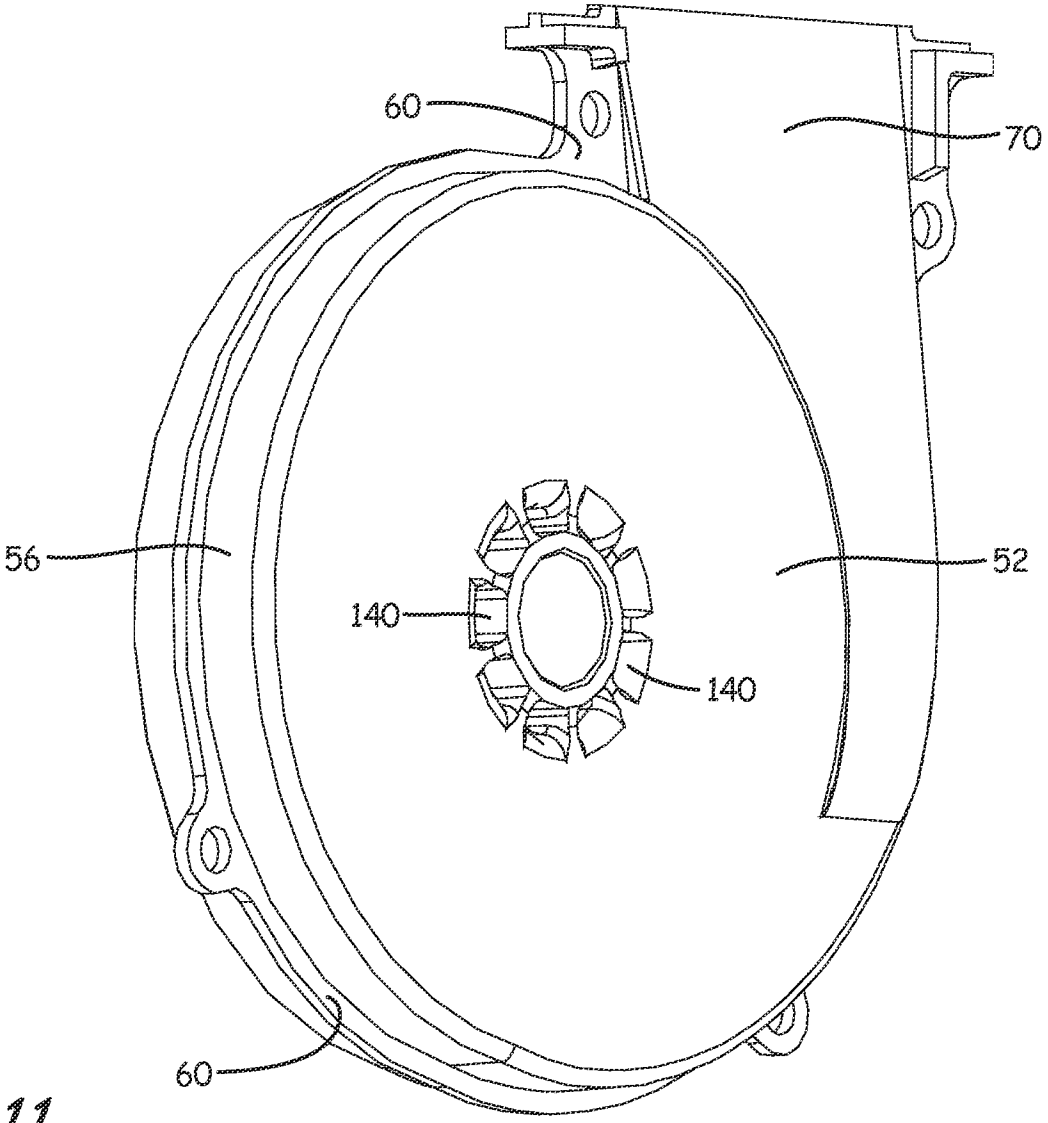
FIG. 11 is a back perspective view of the frame of the type shown in FIG. 10.
Figure 12:
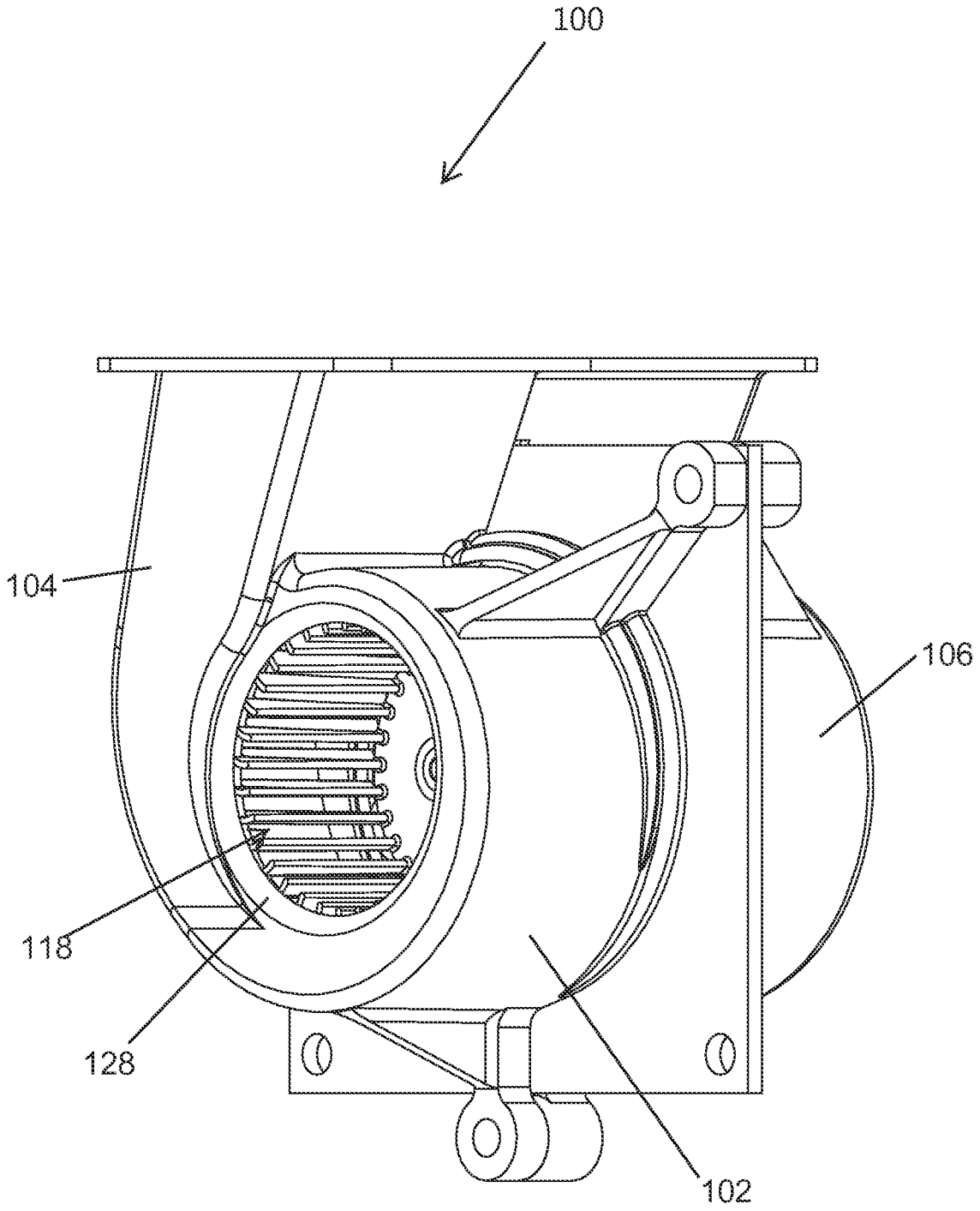
FIG. 12 is a front left side perspective view of an embodiment of the centrifugal blower of the present invention.
Figure 13:
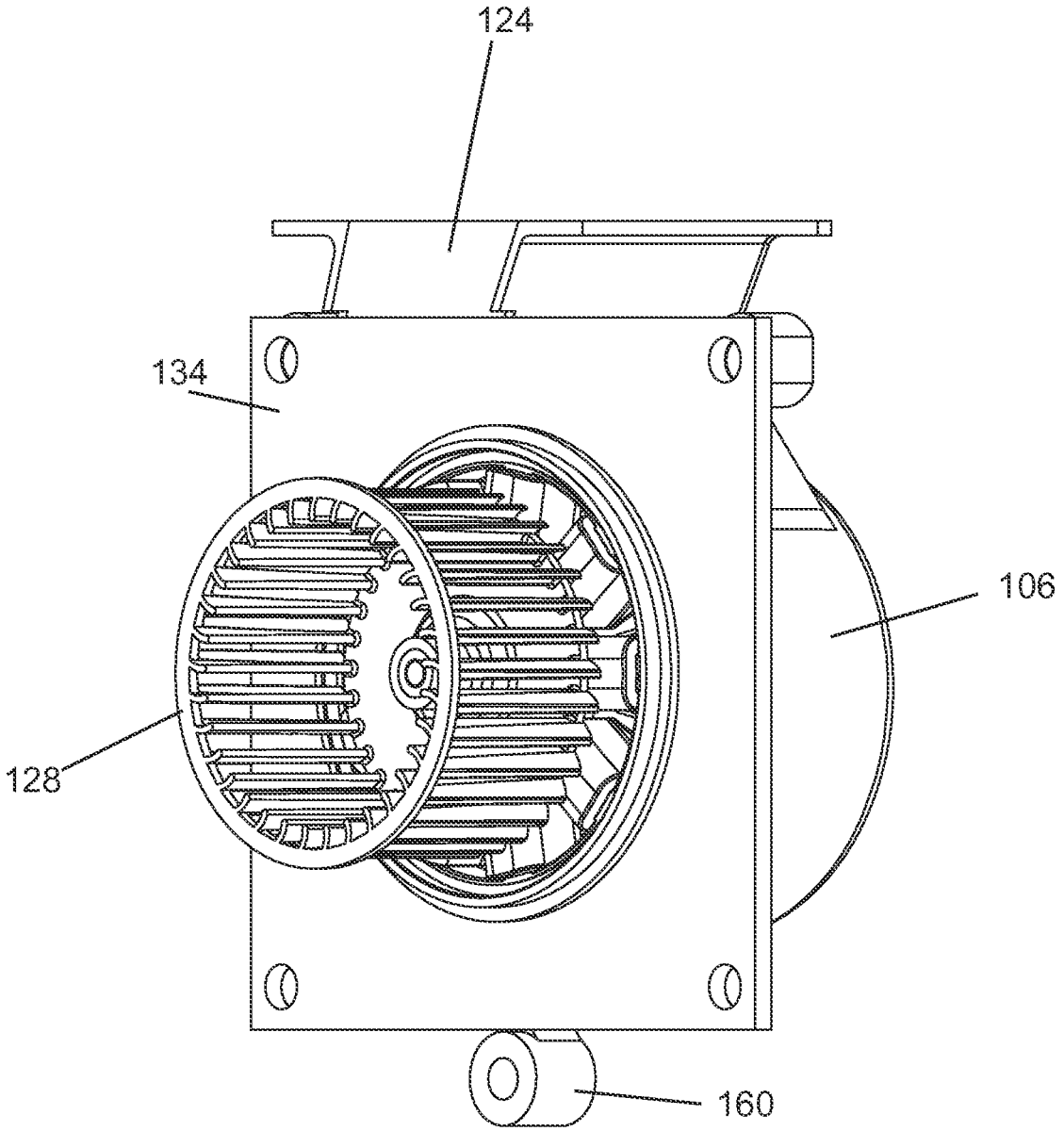
FIG. 13 is a front left side perspective view of the centrifugal blower of the type shown in FIG. 12 and illustrating the left blower housing removed.
Figure 14:
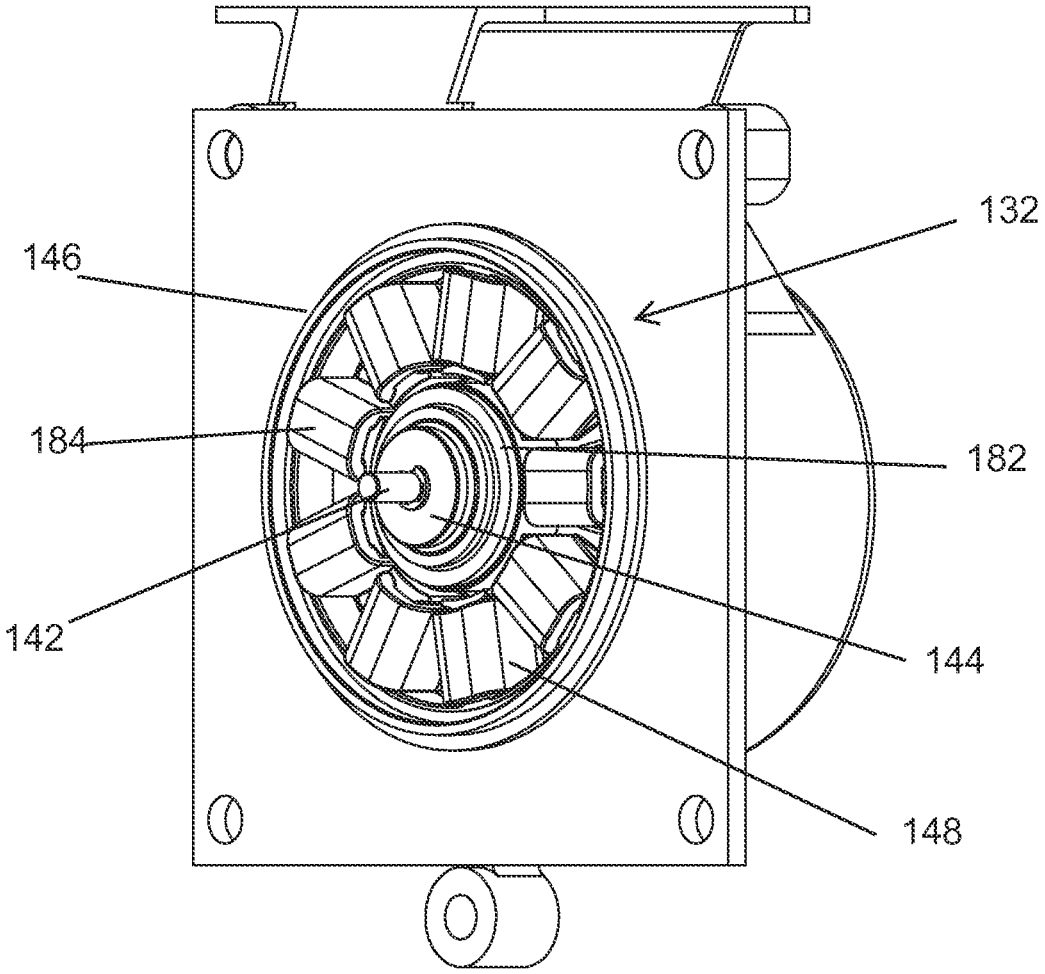
FIG. 14 is a front left side perspective view of the centrifugal blower of the type shown in FIG. 12 and illustrating the left blower housing and left impeller removed.
Figure 15:
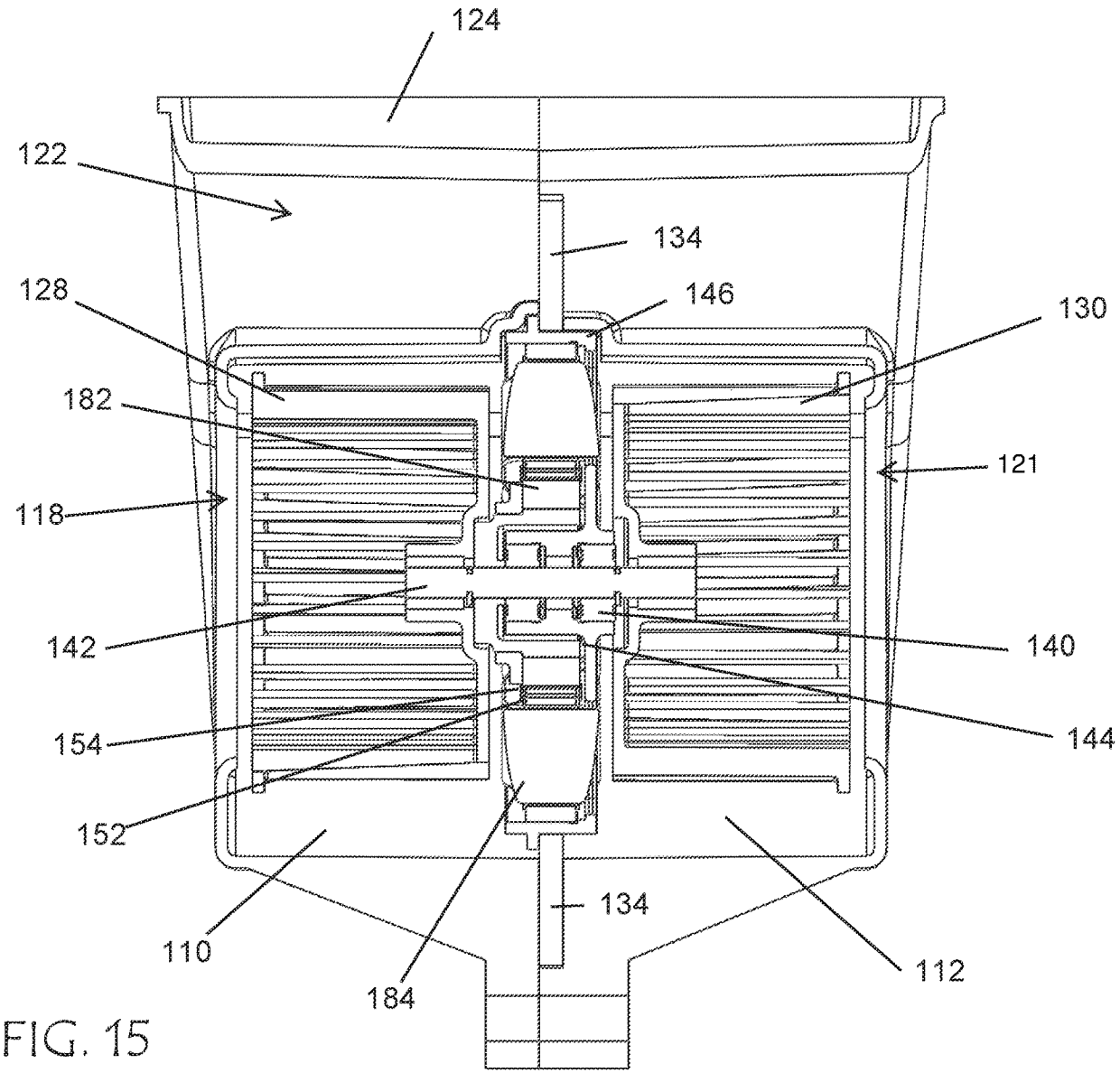
FIG. 15 is a partial sectional front perspective view of the centrifugal blower of the type shown in FIG. 12.
Figure 16:
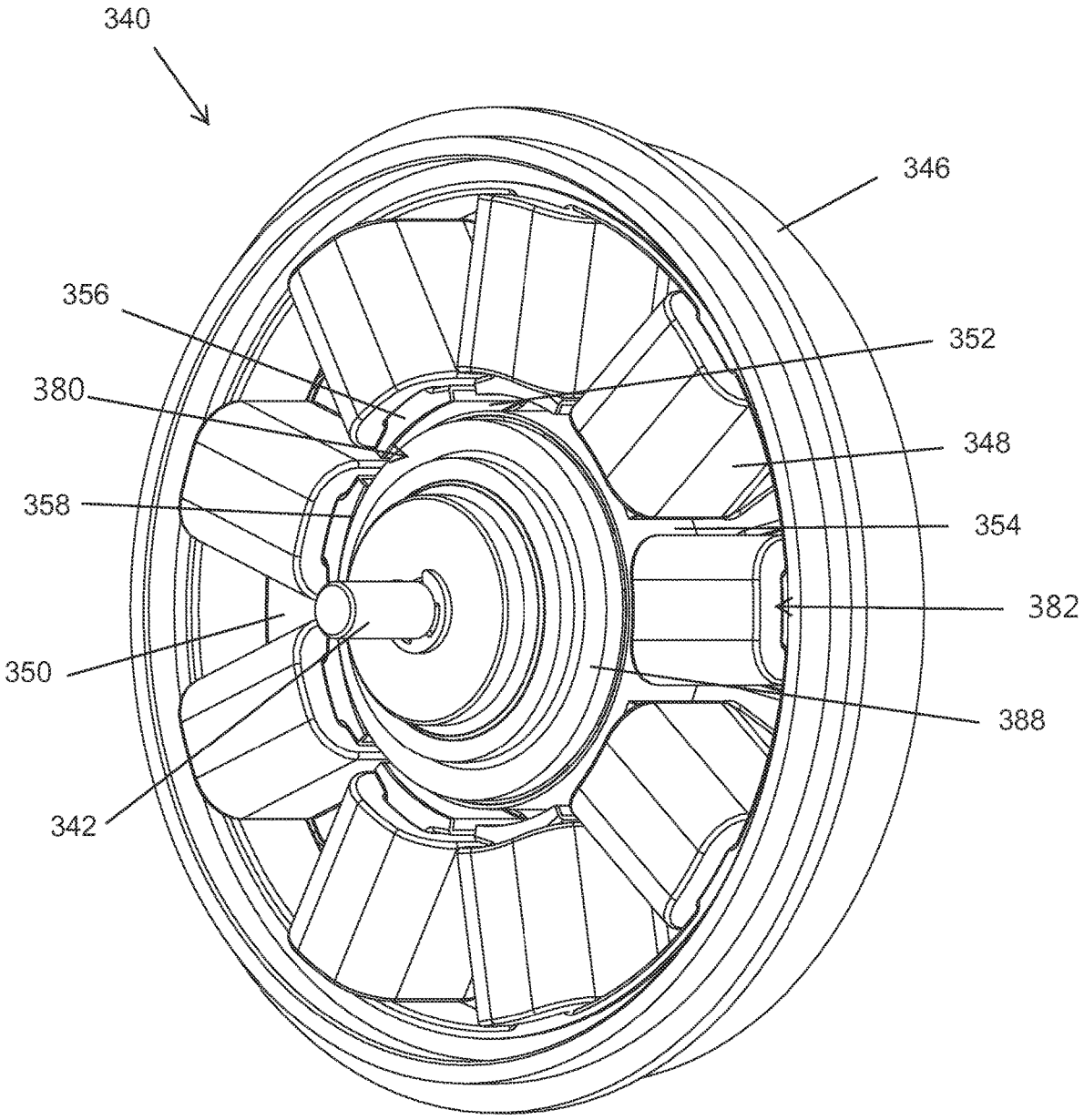
FIG. 16 is a front left perspective view of an embodiment of the motor and motor mount of the present invention.
Figure 17:
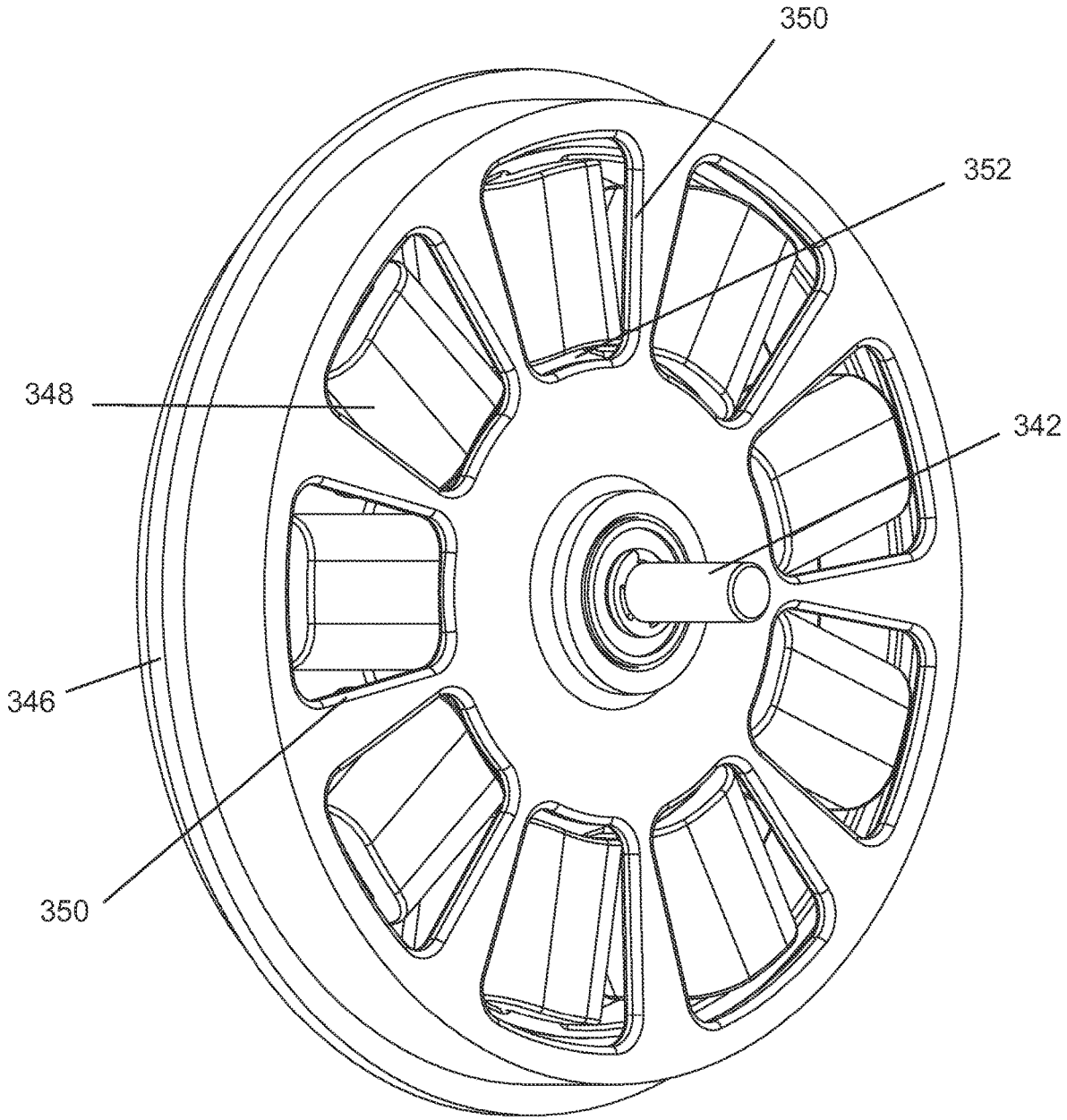
FIG. 17 is a front right perspective view of an embodiment of the motor and motor mount of the present invention.
Figure 18:
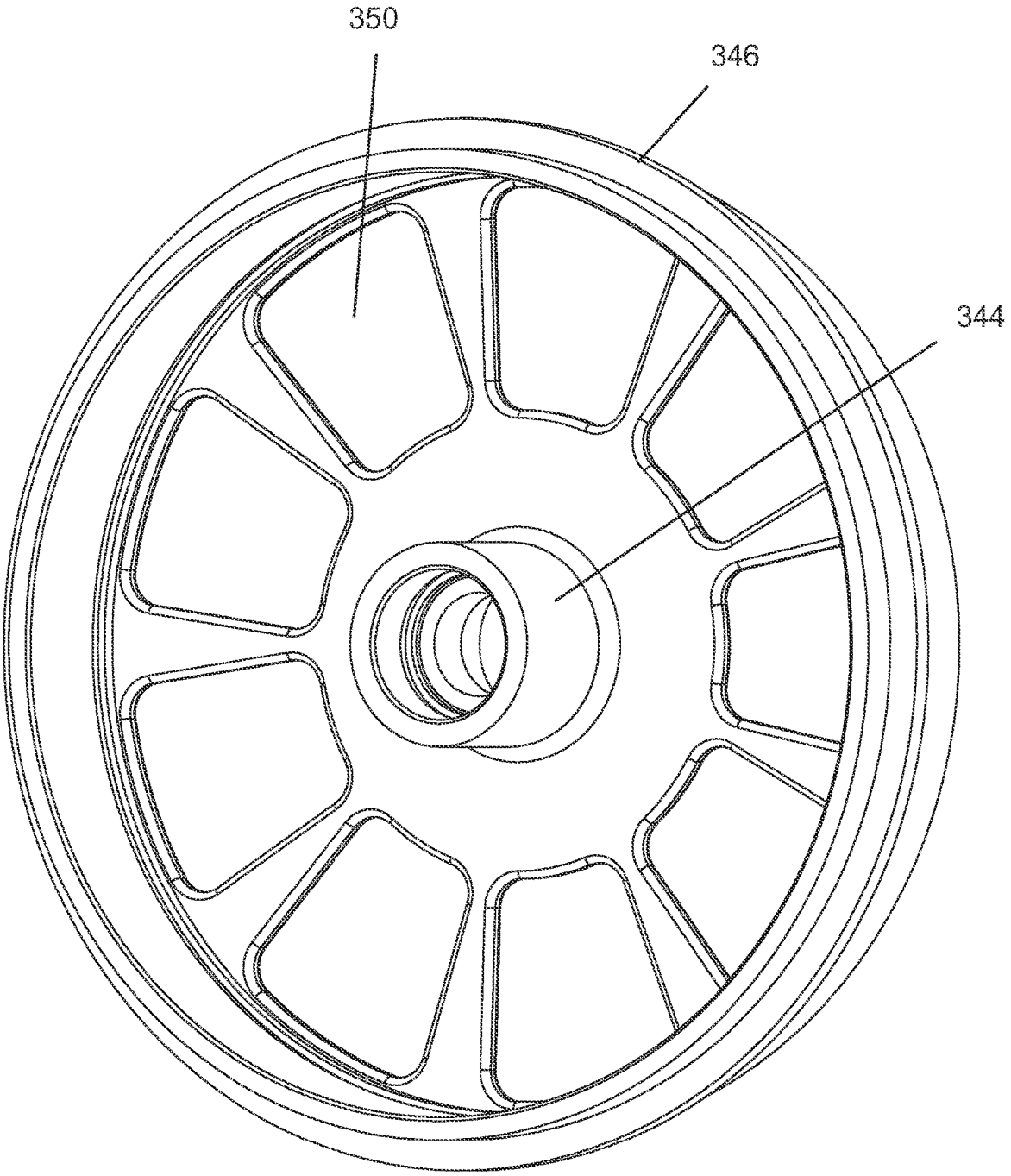
FIG. 18 is a front left perspective view of the motor mount or adapter of the type shown in FIG. 16.
Figure 19:
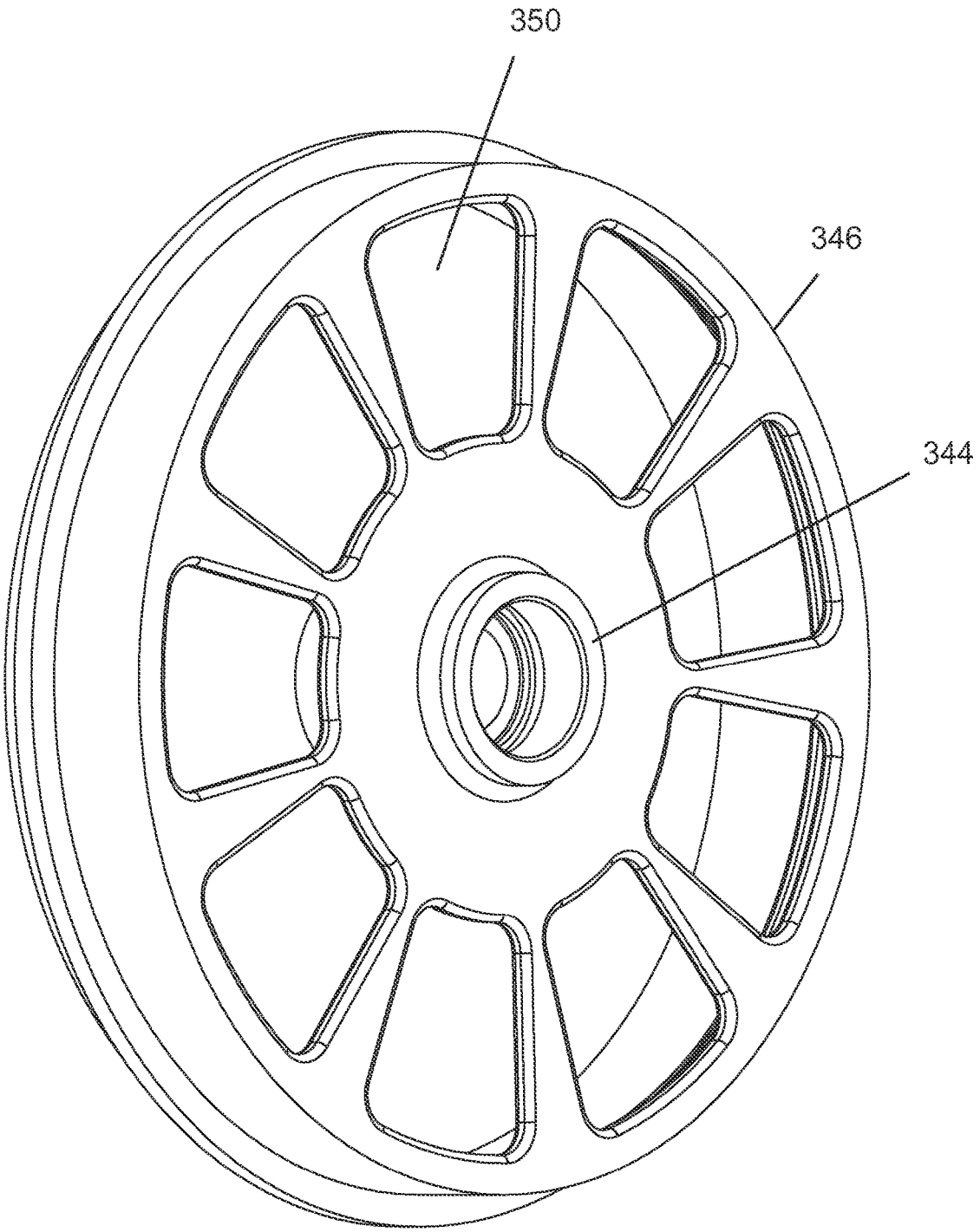
FIG. 19 is a front right perspective view of the motor mount or adapter of the type shown in FIG. 17.
Figure 20:
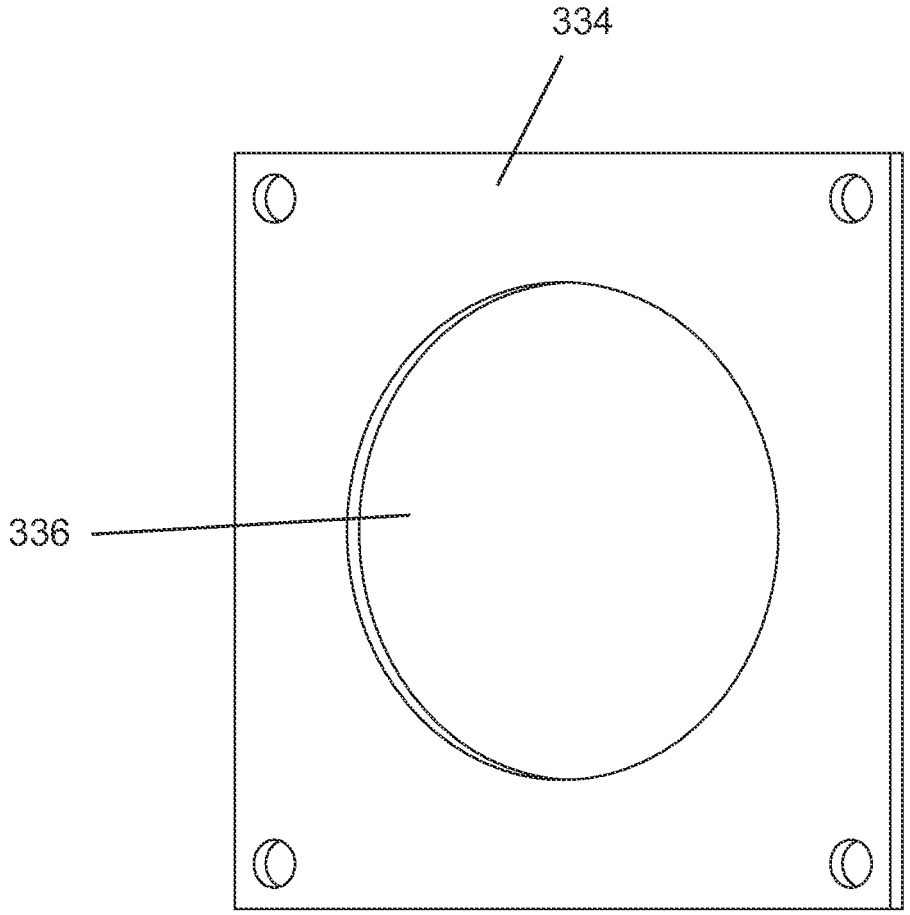
FIG. 20 is a front left perspective view of an embodiment of the motor support of the present invention showing the motor support printed circuit board components removed.
Figure 21:
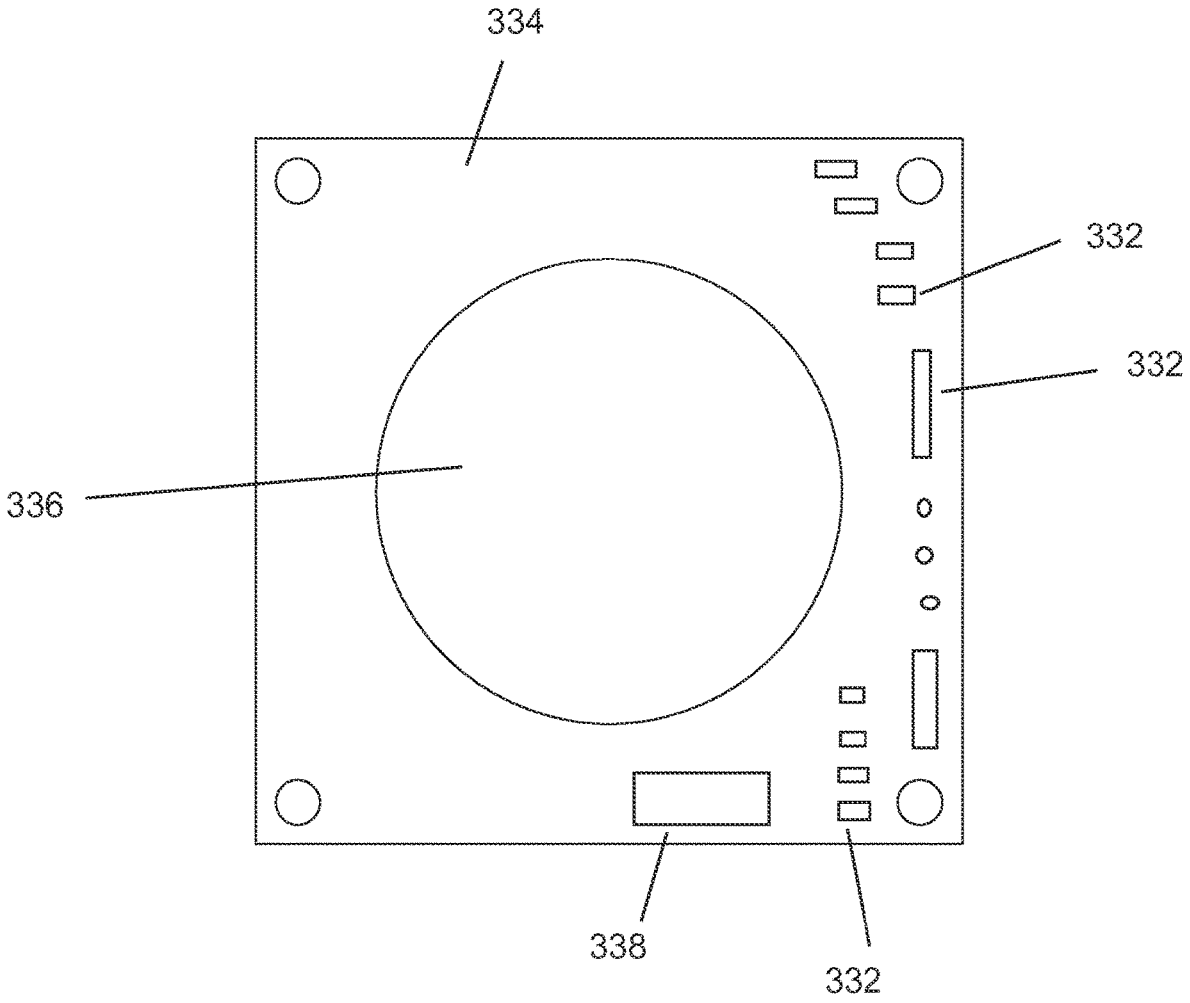
FIG. 21 is a side perspective view of an embodiment of the motor support of the present invention showing portion of an exemplary component layout of a motor support printed circuit board.

Upright portion 52 of frame 34 may be substantially disk-shaped, or may instead be defined by a plurality of circumaxially spaced-apart upright members extending radially between central portion 48 and upper brace portion 56 of frame 34, and arranged annularly about blower axis 26. Upright portion 52 created through a plurality of upright members 52*a* may be an advantageous design for cost savings, weight savings, and aerodynamic benefits. The weight savings is of particular significance when frame 34 is constructed from a cast aluminum, however, it has been found that filling the openings, created by radially extending upright members 52*a*, with a lightweight potting increases efficiency of adjacent coils 93. Further, when upright portion 52 is constructed to form a solid or continuous backing, the wall may include a plurality of radially spaced reliefs or recesses 140 that extend or core into the region of the central portion 48 to reduce the weight and materials of the frame 34 (see, for example, FIG. 11).

An embodiment illustrated in FIGS. 8-11 shows frame 34 including a bearing housing portion 36 that may be integrally formed with frame 34 to form a bearing chamber as previously described. Impeller shaft 42 is therefore arranged in central portion or hub 48 to rotate about blower axis 26. Stator 84 is aligned and engaged within stator support portion 46 that extends radially outwardly from central portion 48 of frame 34. The stator support portion 46 creates a pocket for stator 84 and a width of the pocket is approximately centered with midportion 33 of housing 12. The upright portion 52 forms a continuous, solid, bottom or back plate of the pocket. Annular upper brace portion 56 extends from upright portion 52 in a direction substantially parallel to blower axis 26 and includes housing mount 60 extending radially outward from an outer mid portion of the upper brace portion 56.

Figure 3:
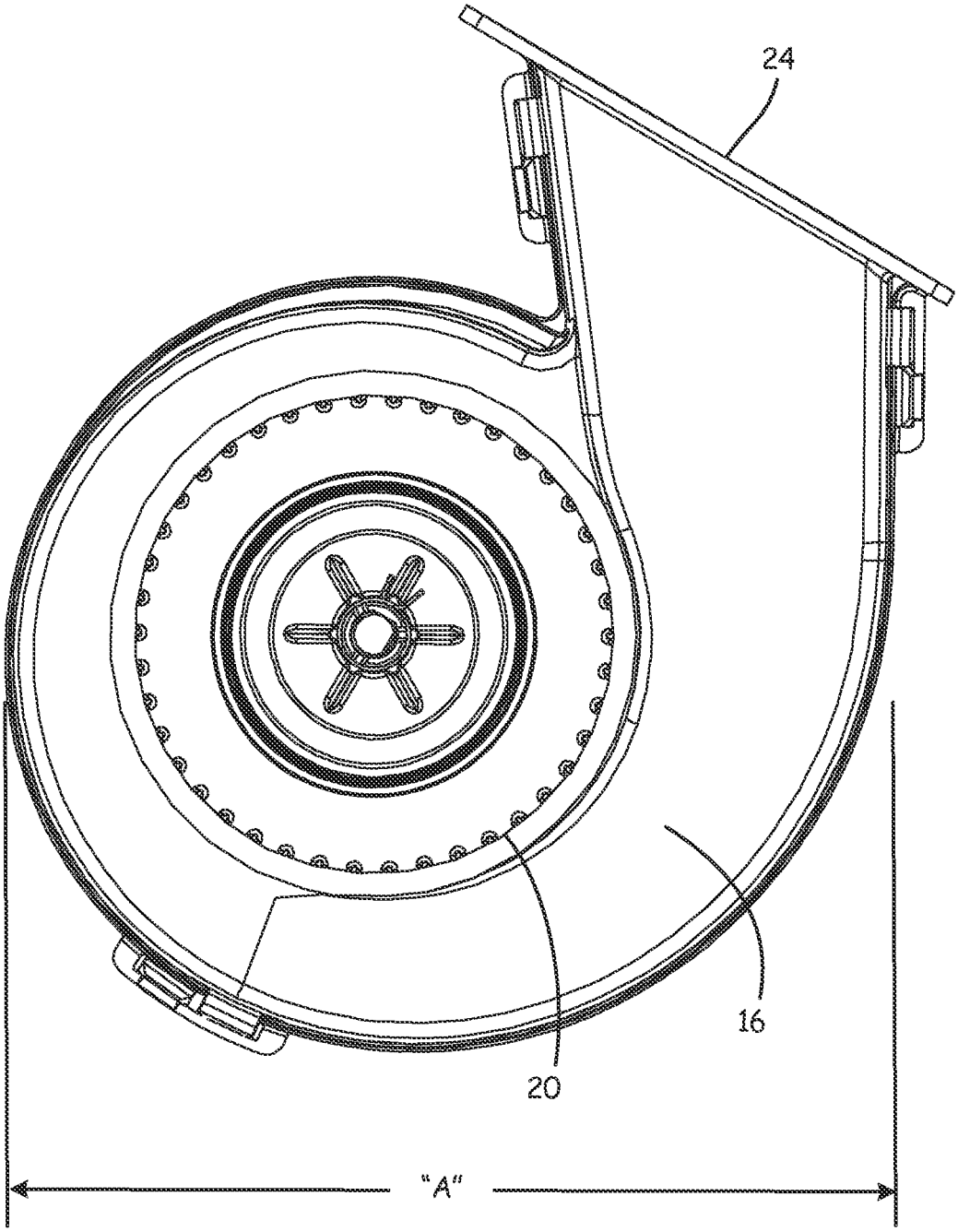
FIG. 3 is a side elevational view of the blower illustrated in FIGS. 1 and 2.
Figure 4:
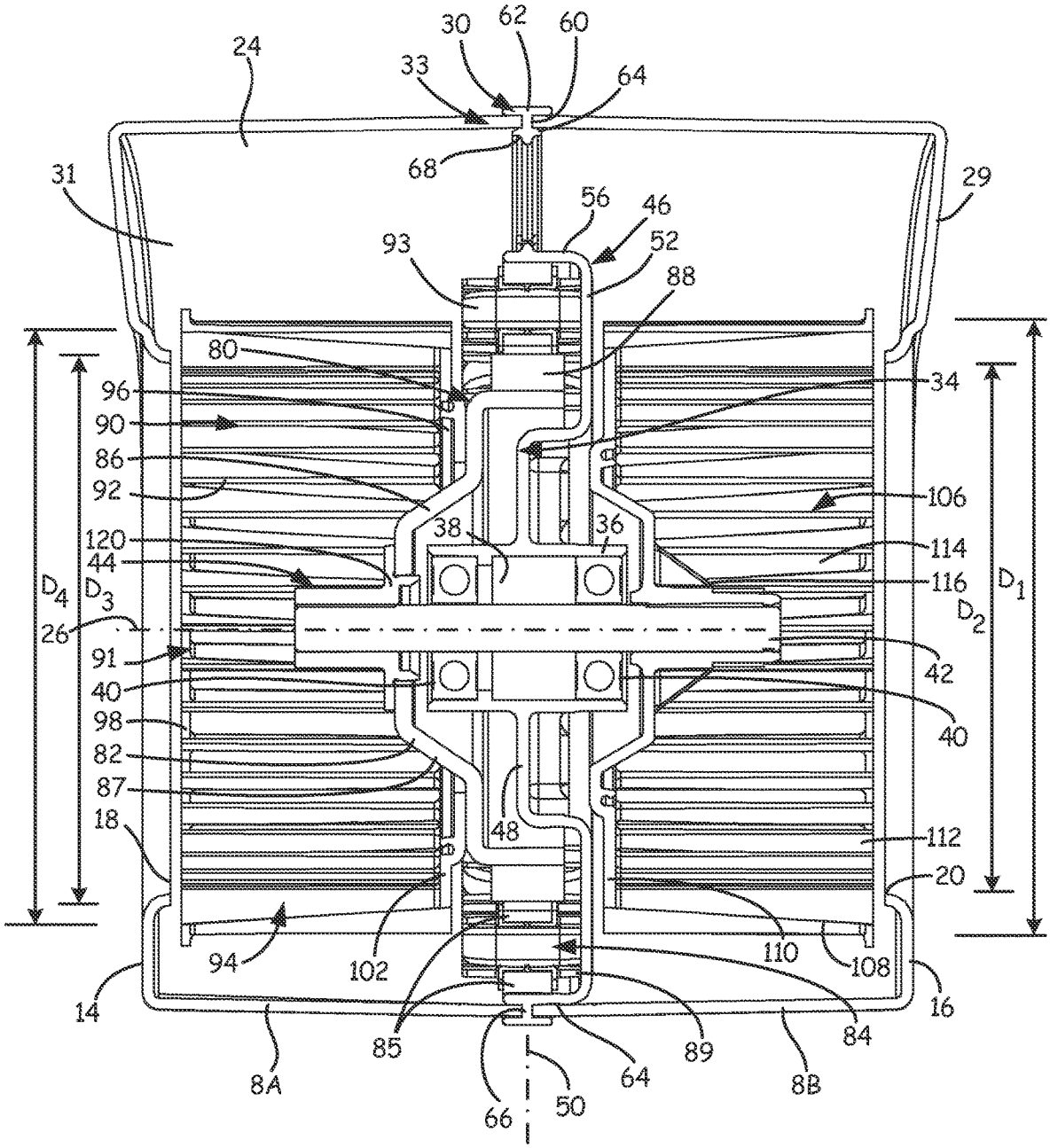
FIG. 4 is a cross-sectional elevational view of the blower illustrated in FIGS. 1-3.
Figure 5:
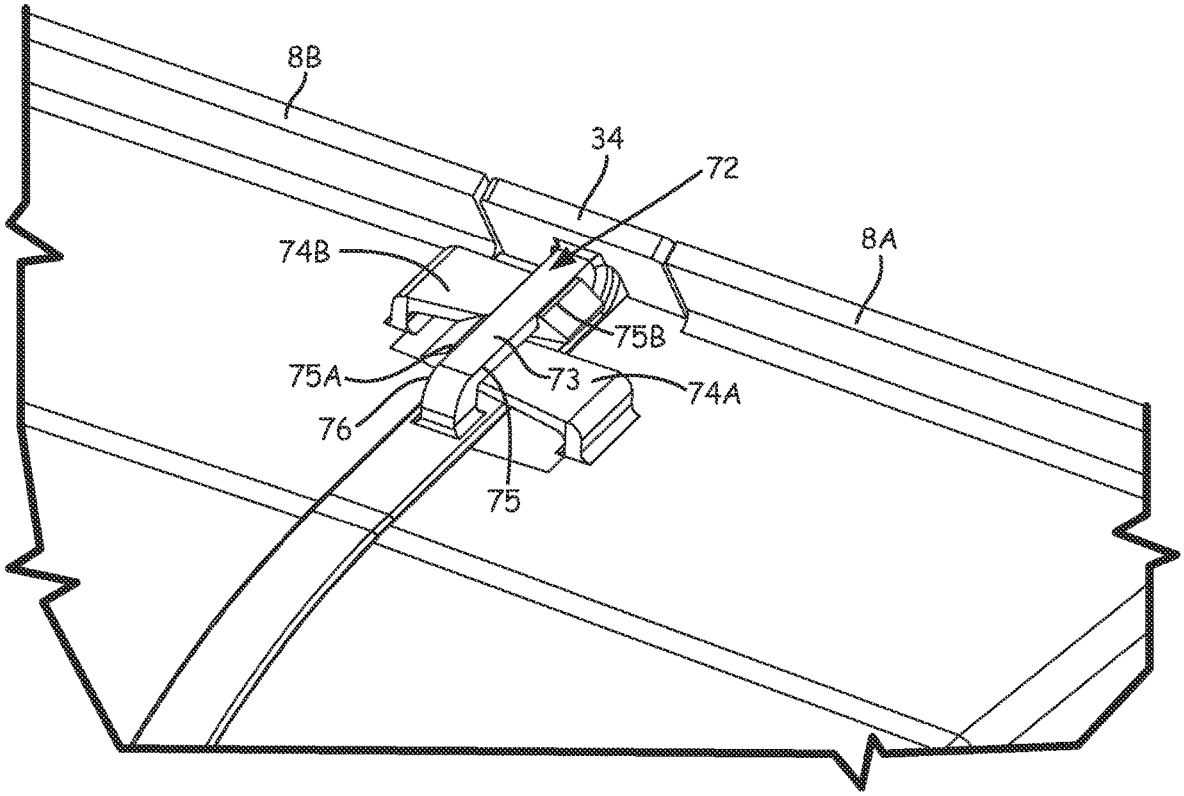
FIG. 5 is a perspective view of a portion of the blower illustrated in FIGS. 1-4.
Figure 6:
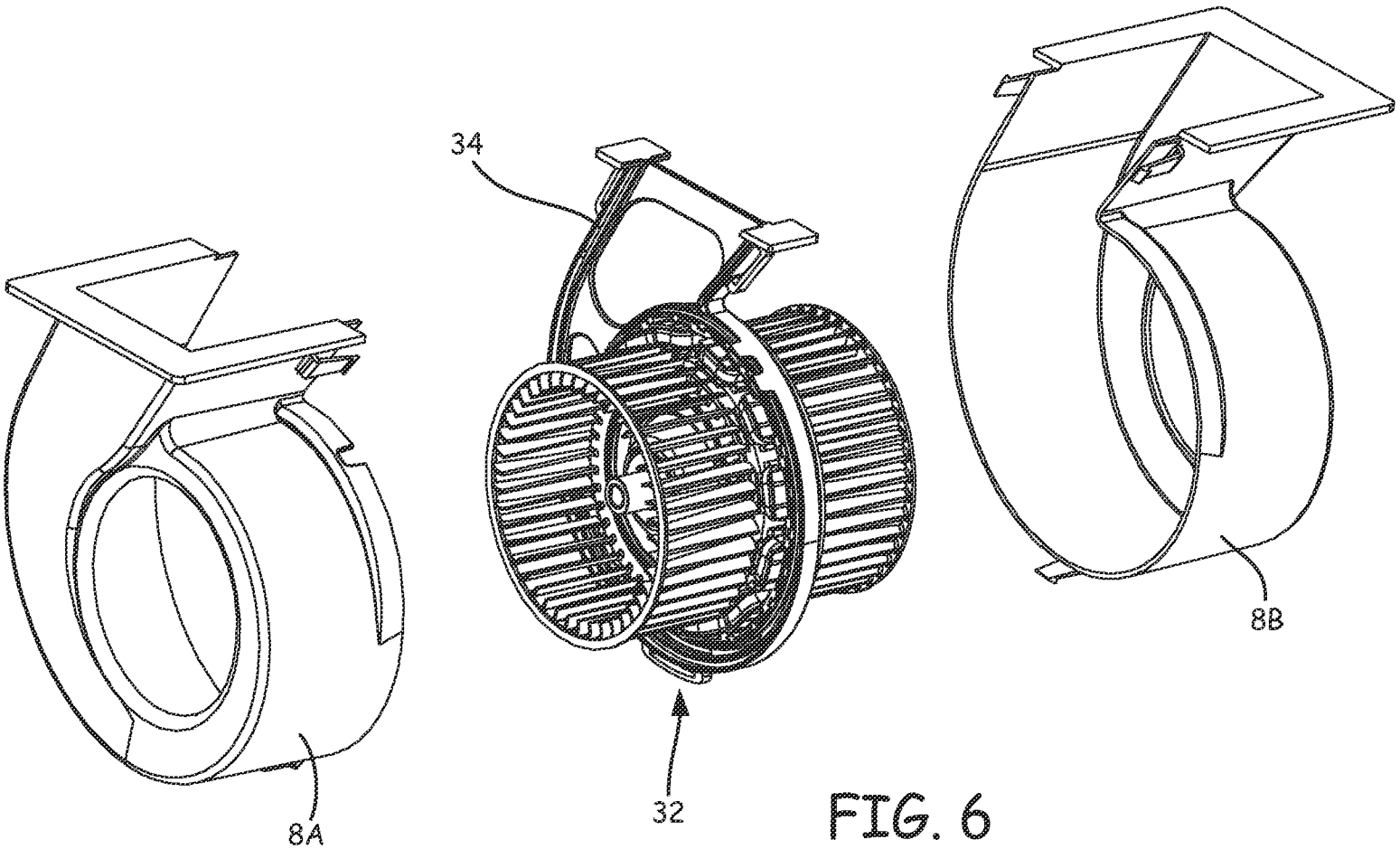
FIG. 6 is an exploded perspective view of the blower illustrated in FIGS. 1-5.
Figure 7B:
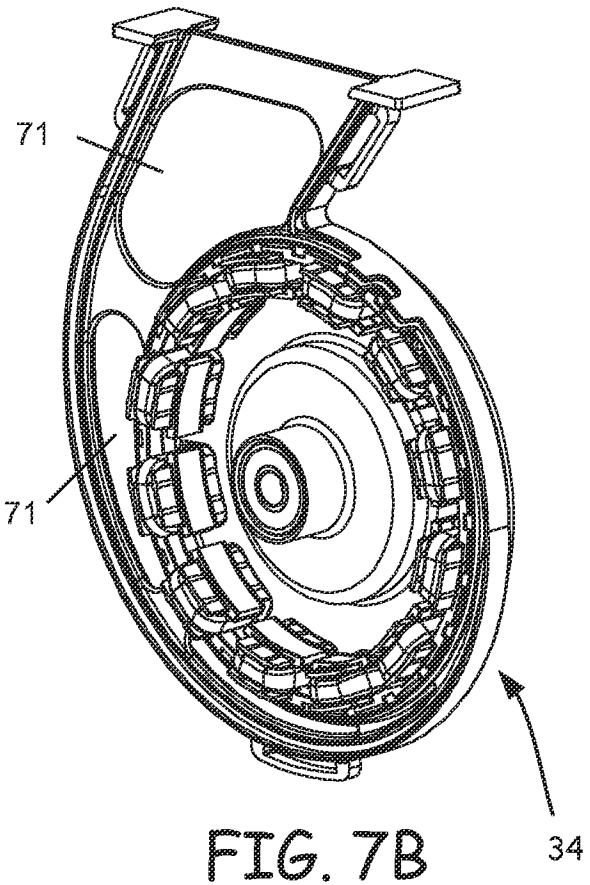
FIG. 7B is an assembled perspective schematic illustration of the components in FIG. 7A.
Figure 7A:
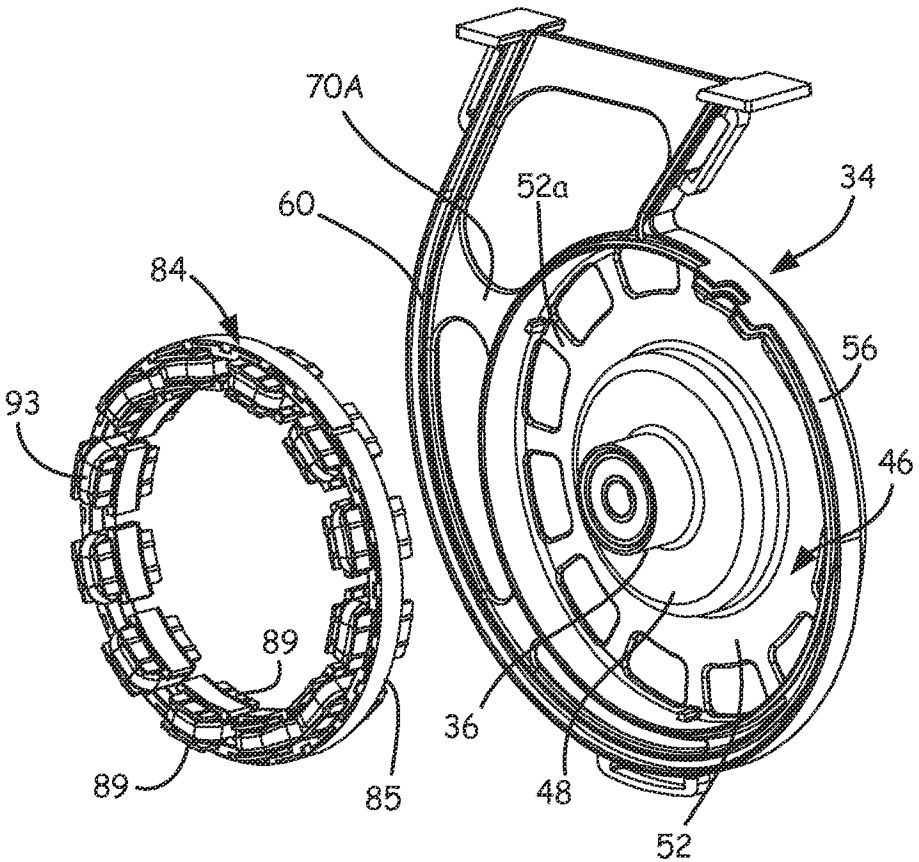
FIG. 7A is an exploded perspective schematic illustration of the frame and stator components of the blower illustrated in FIGS. 1-6.
Figure 8:
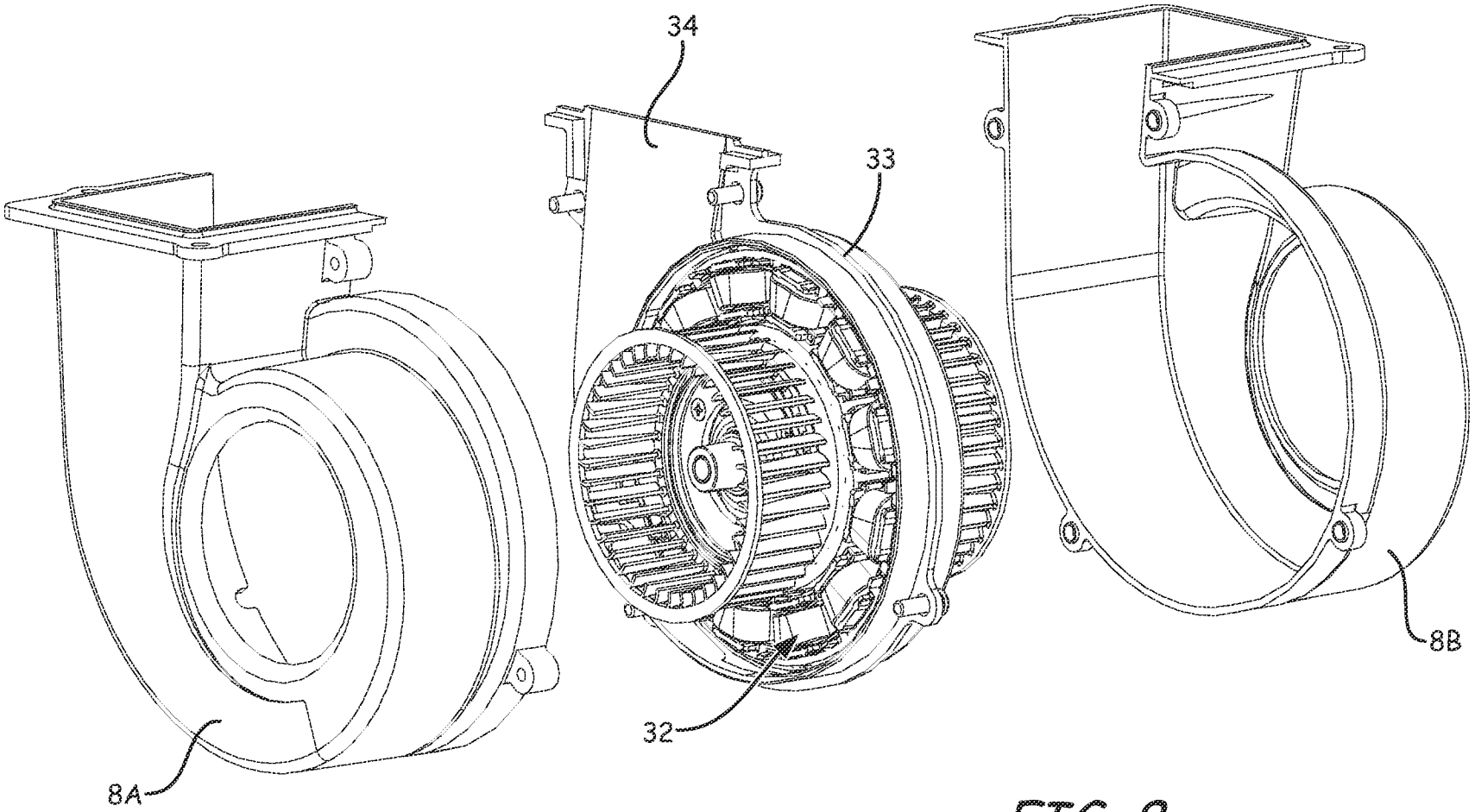
FIG. 8 is an exploded perspective view of an embodiment of the centrifugal blower of the present invention.
Figure 9:
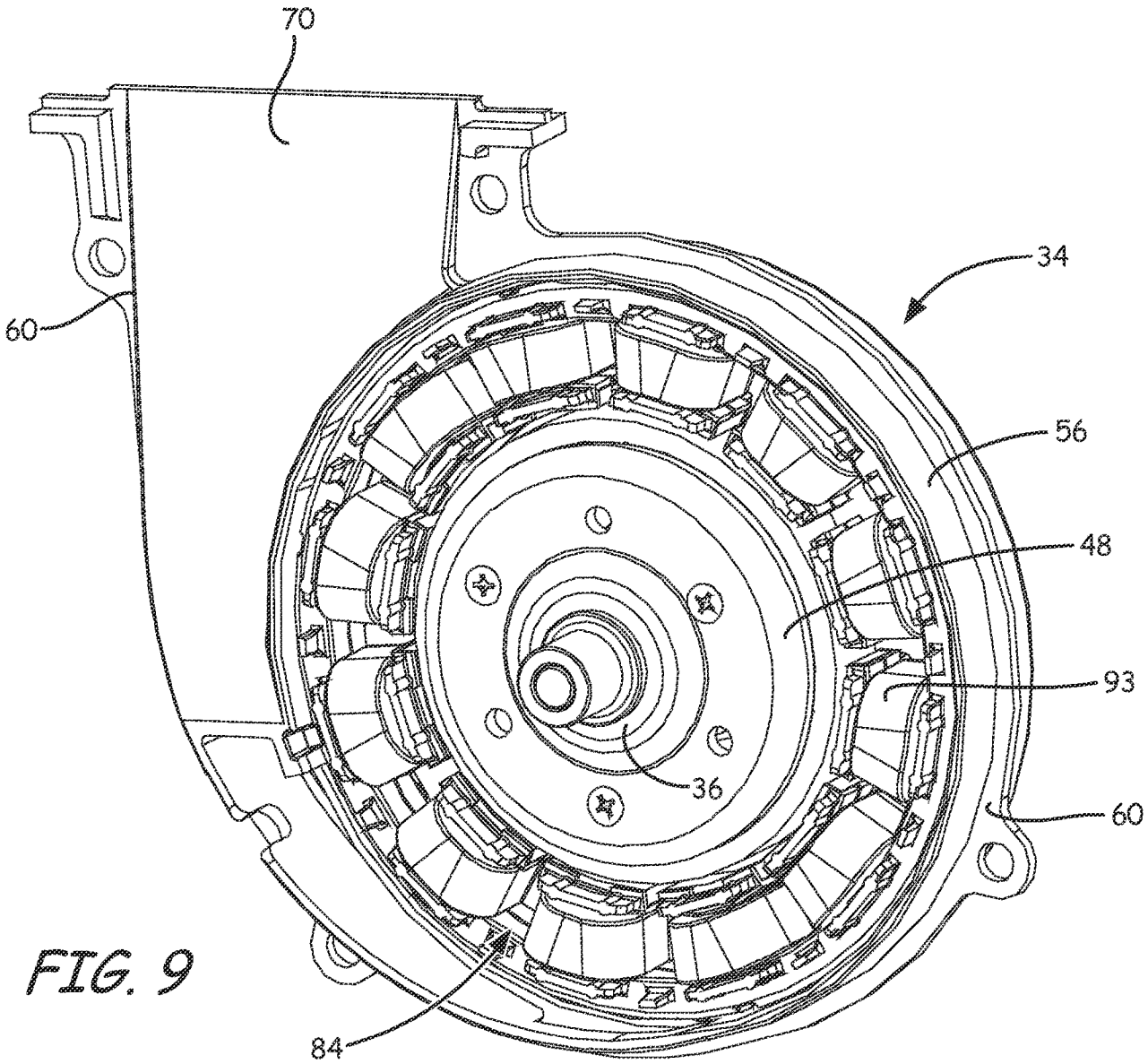
FIG. 9 is a perspective schematic illustration of the frame and stator components of the blower of the type shown in FIG. 8.
Figure 10:
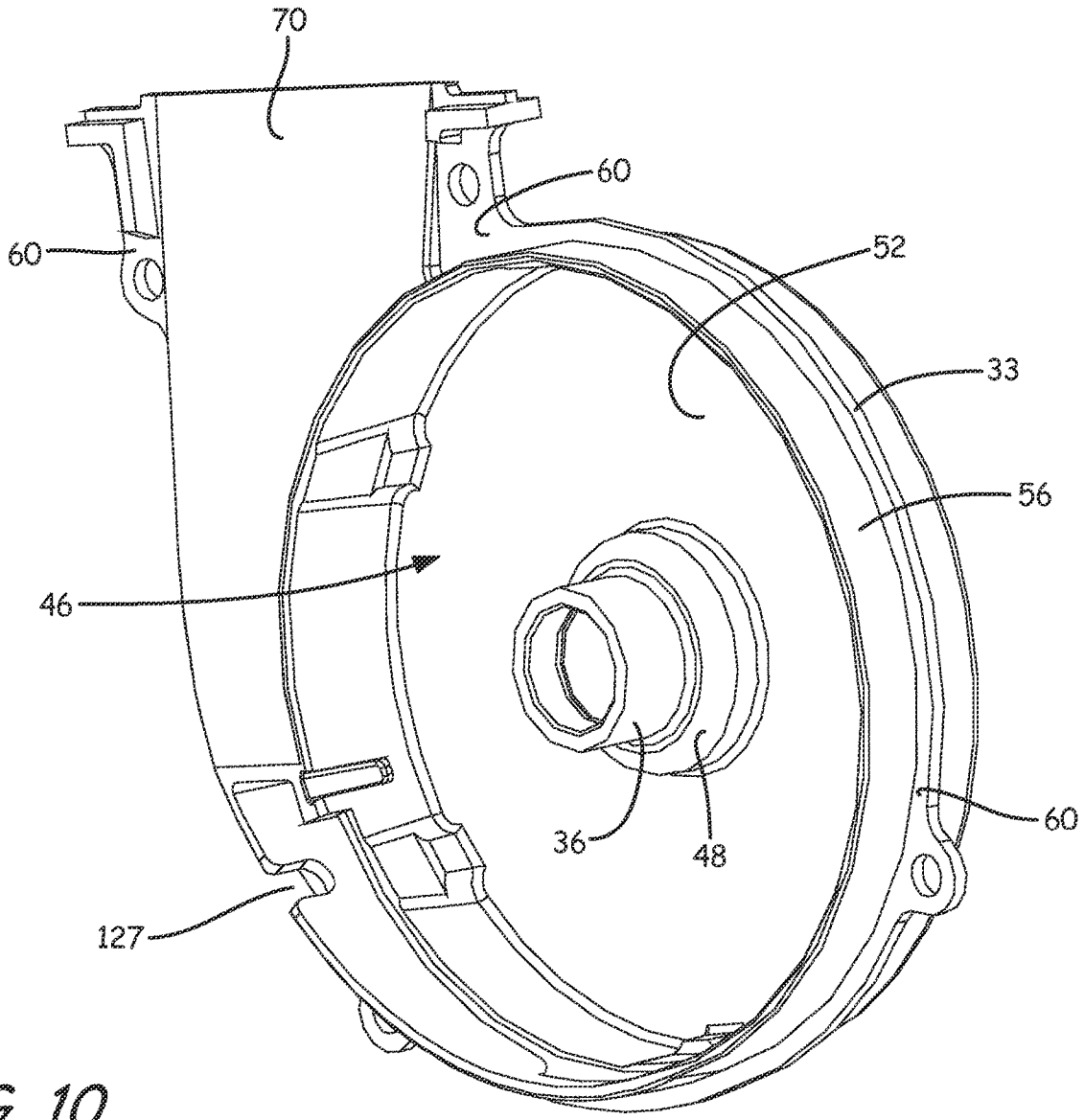
FIG. 10 is a front perspective view of the frame of the type shown in FIG. 8.

Frame 34 further includes a housing mount portion 60 extending radially outwardly from upper brace portion 56 with a configuration suitable for securement of housing 12 thereto. In an embodiment of the invention, housing mount portion 60 may include an outer tab 62 and an inner surface 64 between which is defined a groove 66 that is sized and configured to receive housing 12. Inner surface 64 may comprise a surface of upper brace portion 56, or a surface of an inner tab 68 of housing mount portion 60. As best illustrated in FIG. 3, as a result of the scroll-shaped housing 12, a radius of housing mount portion 60 from blower axis 26 is not constant. Instead, a radius of housing mount portion 60 expands toward outlet 24 of housing 12 to accommodate the expanding scroll shape of housing 12. Alternatively, as illustrated in FIGS. 8-11, the mount portion 60 may include apertures that align with corresponding apertures formed in corresponding tabs of housing sections 8A and 8B in a manner to sandwich the frame 34 between the two housing sections and adapted to receive bolts therethrough and to facilitate the bolting together of housing sections.

Frame 34 may also include a support portion 70 extending between upper brace portion 56 and housing mount portion 60. Support portion 70 may be a solid or continuous body (as illustrated in FIGS. 8-11), or a plurality of distinct support portion members 70A (as illustrated, for example, in FIGS. 2 and 7*a*). It is contemplated that a series of distinct support portion members 70A may provide a weight savings, cost savings, and aerodynamic benefit over a continuous support portion 70 extending continuously between upper brace portion 56 and housing mount portion 60. It is further contemplated that an aerodynamic and performance benefit may be realized when a portion of frame 34 is continuous or a solid body in regions adjacent the stator (without apertures or upright members 52A) and when other portions of the frame 34, radially exterior to the stator, includes relief apertures or the above described support portion members 70A.

Housing mount portion 60 defines coupling location 30 at which housing 12 is secured to operating system 32. Preferably, operating system 32 is coupled with housing 12 only at coupling location 30. As described in greater detail below, coupling location 30 is preferably disposed in a blower outlet portion 29 of housing 12 to minimize the aerodynamic impact of frame 34 in the operation of blower apparatus 10. In an illustrated embodiment, first and second housing sections 8A, 8B nest in respective grooves 66 of housing mount portion 60. In some embodiments, first and second housing sections 8A, 8B may be further secured to frame 34 at a locking cleat 72 of frame 34, wherein locking tabs 74A, 74B snap together to engage with locking cleat 72. Locking tabs 74A, 74B resiliently engage under an upper bar 73 of locking cleat 72, with a protrusion portion 75A, 75B of locking tabs 74A, 74B being urged through the resilience of locking tabs 74A, 74B into engagement with retention surfaces 75, 76 of locking cleat 72. In other embodiments, however, first and second housing sections 8A, 8B may be fastened, bolted, welded, soldered, or otherwise secured to one another and/or frame 34, as desired per application.

Operating system 32 further includes a motor 80 that includes hub 44, a rotor 82 that is rotatably driven about blower axis 26, and a stator 84. Rotor 82 may include a rotor core or back iron 86 with a rotor element 88 annularly arranged about hub 44. Rotor 82 may further include a first impeller portion 90 including impeller blades 92 for motivating air out from blower chamber 22 through air outlet 24. As illustrated, stator 84 may be annularly arranged radially outwardly about rotor element 88, which may compromise a magnet secured to rotor core 86.

In some embodiments, impeller blades 92 of impeller portion 90 extend in a substantially axial direction from rotor core 86, such that rotor core 86 forms a first impeller hub 87 to drive circumaxial motion of impeller blades 92 about blower axis 26, defined by rotor core 86 rotating with shaft 42 about blower axis 26. In such an embodiment, impeller portion 90 may be integrally formed with rotor 82, or may be secured directly thereto with fasteners, adhesives, weldments, or the like.

Impeller portion 90 may instead constitute a distinct first impeller 91 coupled to rotor 82 for rotation about blower axis 26. First impeller 91 may be secured to rotor 82 so as to rotate in unison with rotor 82 and shaft 42 about blower axis 26. First impeller 91 may comprise a first wheel 94 having an inner flange 96, an outer flange 98, and impeller blades 92 secured there between. In addition, first impeller 91 may include a coupling bracket 102 for securing first impeller 91 to rotor core 86 of rotor 82. Coupling bracket 102 may be secured to rotor core 86 through fasteners, adhesives, welds, or the like. First impeller 91 has a first diameter "D1" that may be somewhat greater than first air inlet diameter "D2" but may be substantially equal to a rotor diameter "D3". It is contemplated by the present invention that rotor diameter D3 may be somewhat greater or lesser than first diameter D1 of first impeller 91. However, such variances are considered to be within the scope of the term "substantially equal", as used herein. In particular, the term "substantially equal", as used herein, isintended to mean within +/−15% difference between the two dimensions or properties being compared.

In the illustrated embodiment, motor 80 includes a second impeller 106 having a second wheel 108 having an inner flange 110, and outer flange 112, and second impeller blades 114 secured along a substantially axial direction between inner and outer flanges 110, 112. Second impeller 106 is preferably arranged for motivating air out from blower chamber 22 through air outlet 24, and may be secured to shaft 42 to be rotatably driven about blower axis 26 by the circumaxial rotation of rotor 82. Second impeller 106 may be secured to shaft 42 in a manner which provides rotation of second impeller 106 in unison with first impeller 91. Typically, such an arrangement is facilitated through respective couplings of first impeller 91 and second impeller 106 to shaft 42 to rotate in unison with shaft 42 about blower axis 26. Second impeller 106 may be secured to shaft 42 with a ring clamp 116 or other suitable fastening mechanism. As described above, first impeller 91 may be coupled to shaft 42 through its connection or integration with rotor 82. In the illustrated embodiment, rotor 82 is coupled to shaft 42 at a hub collar 120, which is itself fixedly secured to shaft 42.

One or more of first and second impellers 91, 106 may include forward-curved impeller blades 92, 114. The term "forward-curved" is understood in the art as an orientation of impeller blades 92, 114 that is distinguished from "radial" or "backward-curved" orientations. It has been found by the applicants that, at least in some embodiments, forward-curved impeller blades may provide aerodynamic advantages to the operation of blower apparatus 10.

First and second air inlets 18, 20 may be substantially axially aligned along blower axis 26, in that blower axis 26 extends through a radial centerpoint of substantially circular first and second air inlets 18, 20.

Motor 80 may be a brushless, direct-current electromagnetic motor in which rotor 82 is electromagnetically driven circumaxially about blower axis 26 by a stationary stator 84, as is understood in the art. In the present arrangement, however, stator 84 may be closely radially outwardly positioned with respect to rotor 82, and precisely secured to frame 34 in order to minimize necessary clearances as between the stationary stator 84 and the rotating rotor 82. Stator 84 may be pressed, glued, fastened, swaged, staked, and the like to stator support portion 46 of frame 34 annularly about magnetic rotor element 88 of rotor 82. Magnetic rotor element 88 may be bonded or fastened to rotor core 86 in a position that is substantially radially and annularly aligned with stator 84, such that stator 84 and rotor element 88 are annular rings annularly aligned with mid-plane 50. It is contemplated, however, that rotor element 88 and stator 84 may be somewhat axially displaced from one another, so as to not be precisely annularly aligned about hub 44. The arrangement of stator 84 and rotor element 88, however, is preferably suitable for efficiently driving the rotation of rotor 82.

Stator 84 includes a welded lamination stack 85 with molded insulators 89 and electrically conductive coils 93. Insulators 89 are secured between lamination stack 85 and coils 93, as is known in the art. Stator 84 is therefore compactly arranged circumaxially about blower axis 26 and in close radial outward proximity to magnetic rotor element 88.

In some embodiments, for example, an inner diameter D4 of stator 84 may be substantially equal to first diameter D1 of first impeller 91. Thus, each of first diameter D1, an outer diameter of rotor element 88, and an inner diameter of stator 84 may be substantially equal to one another. Such an arrangement provides for a relatively compact motor 80 with minimized clearances and resultant high efficiencies. Moreover, motor 80 may be completely contained within the standard scroll-shaped housing 12, and yet provide enhanced motor output as a consequence of a relatively long leverage arm afforded by an enlarged diameter D1, D3, D4 as compared to conventional motors located in the blower hub area. A particular arrangement provides for stator 84 concentrically arranged about rotor element 88.

An aspect of the present invention which enhances aerodynamic efficiency over conventional approaches is in locating the stator and the connection between the operating system and the housing downstream from the impeller. For the purposes hereof, the term "downstream" is intended to refer to the airflow progress through blower apparatus 10. In this regard, first and second air inlets 18, 20 are "upstream" from first and second impellers 91, 106, respectively. Airflow enters a respective first or second air inlet 18, 20 to encounter a respective first or second impeller 91, 106, so as to be directed into an outlet plenum 31 of housing 12, and ultimately out through air outlet 24. Consequently, those structures or components identified as being "downstream" of another structure or component is located in blower apparatus 10 in a position which is exposed to the cooling air subsequent to the comparison structure or component during the normal operation of blower apparatus 10. In this case, therefore, coupling location 30 is disposed at the portion of housing 12 defining outlet plenum 31, fluidly downstream from impellers 91, 106. In this manner, motor 80 of the present invention uses space within housing 12 that is far less sensitive to aerodynamic performance than configurations of the prior art. By limiting aerodynamic incursion, the arrangement of the present invention yields higher efficiencies and lower noise levels.

Electrical wiring 125 may be conveniently located at blower housing, and need not extend through a hollow support shaft within the aerodynamic inlet portion. The leads of wiring 125 may therefore extend through an access 127 of housing 12, directly to motor 80.

An embodiment illustrated in FIGS. 12-15 shows centrifugal blower 100 having housing 102 and a motor support 134. The motor support 134 extends through a mid-portion of the housing and divides the interior or blower chamber 122 of the housing into halves or sub-chambers 110 and 112. The first side 104 of the housing has an air inlet 118 forming an opening into the sub-chamber 110 and the second side 106 of the housing 102 has an air inlet 121 forming an opening into sub-chamber 112. First impeller 128 is positioned in sub-chamber 110 and second impeller 130 is positioned in sub-chamber 112. When the impellers 128 and 130 rotate air is drawn into the blower chamber 122 through respective air inlet openings. Airstreams flow into respective first and second air inlets 118 and 121, through the blower chamber 122 and exits out the housing 102 through air outlets 124.

Motor 132 rotates impellers 128 and 130 and is preferably an electronically commutated type which is also known as a brushless DC motor. A brushless motor typically includes a printed circuit board assembly (PCBA) having motor driver components that controls the rotation of the motor. The driver components include, for example, a microprocessor, transistors, resistors, diodes and capacitors. The PCBA is preferably either a composite fiberglass (typically FR-4) or a metal substrate.

The motor support 134 is preferably constructed of the required PCBA of motor 132. Utilizing the PCBA as the motor support 134 reduces the size of the centrifugal blower 100 by eliminating the need for a remotely mounted PCBA. The PCBA motor support 134 also simplifies the construction of the blower, improves efficiency and lowers manufacturing costs. Further, the PCBA motor support 134 lowers power losses in wiring, eliminates connectors that may have failures and a metal substrate PCBA transfers heat away from the motor 132 thus increasing bearing life.

Motor support 134 includes a central aperture 136 extending there through. Motor 132 includes a motor support frame or motor support sleeve or adapter 146 that mounts and firmly engages the motor 132 to the motor support 134 in the central opening or aperture 136. Motor 132 generally includes rotor 182 and stator 184. A hub 144 is attached or is formed integral with the adapter 146. Bearings 140 are contained within hub 144 and are adapted to receive motor shaft or spindle 142. The spindle 142 extends through hub 144 and impellers 128 and 130 are mounted on opposing end portions of the spindle 142. The bearings 140 allow the spindle and impellers to freely rotate within the corresponding sub-chambers 110 and 112. Rotor 182 is also affixed to the spindle 142 along a mid-portion of the spindle such that the rotor is aligned with the stator 184. The outer circumference of rotor 154 is slightly less that the inner circumference of the stator portion adjacent the rotor 182.

Stator 184 may be aligned and engaged within stator pockets formed in the motor support sleeve or adapter 146. The stator windings 148 wind about cores or insulators and are annularly arranged in stator pockets radially outwardly about rotor element 182. Rotor 182 is electromagnetically driven circumaxially (which rotates the spindle and connected impellers) by the stationary stator 184 as is understood in the art. In the present arrangement, however, stator 184 may be closely radially outwardly positioned with respect to rotor 182, and precisely secured to adapter 146 in order to minimize necessary clearances between the stationary stator 184 and the rotating rotor 182. Those skilled in the art will appreciate that the motor support 134 may be modified to include the adapter 146 as an integral component of the motor support 134. Stator 184 may be pressed, glued, fastened, swaged, staked, and the like to the adapter 146.

An embodiment of the motor is shown in greater detail in FIGS. 16-21. The illustrated motor 340 is mounted in a central aperture 336 of the motor support PCBA 334. Electrical power connector 338 and PCB components 332 are mounted and arranged about the PCB in a manner that allows for efficient electrical coupling to a power supply and minimizes interference with the air flow within the centrifugal blower housing. Motor 340 includes hub 344 that is formed integral with the motor support adapter 346. The hub 344 is adapted to contain bearings within hub, wherein the bearings are adapted to receive motor shaft or spindle 342. The spindle 342 extends through hub 344 and impellers are mounted on opposing end portions of the spindle 342. Rotor 380 is also affixed to the spindle 342 along a mid-portion of the spindle such that the rotor is aligned with the stator 382. The outer circumference 354 of rotor 380 is slightly less that the inner circumference 352 of the stator core ends 358 adjacent the rotor.

Stator 382 is aligned and engaged within stator pockets 350 formed in the motor support sleeve or adapter 346. The stator windings 348 wind about cores or insulators 356 and are annularly arranged in the stator pockets 350 radially outwardly about rotor element 380. The core end 358 of the stator core 356 is arranged closely radially outward with respect to a magnetic rotor element 388 of the rotor 380, in order to minimize necessary clearances between the stationary stator 382 and the rotating rotor 380.

Figure 22:
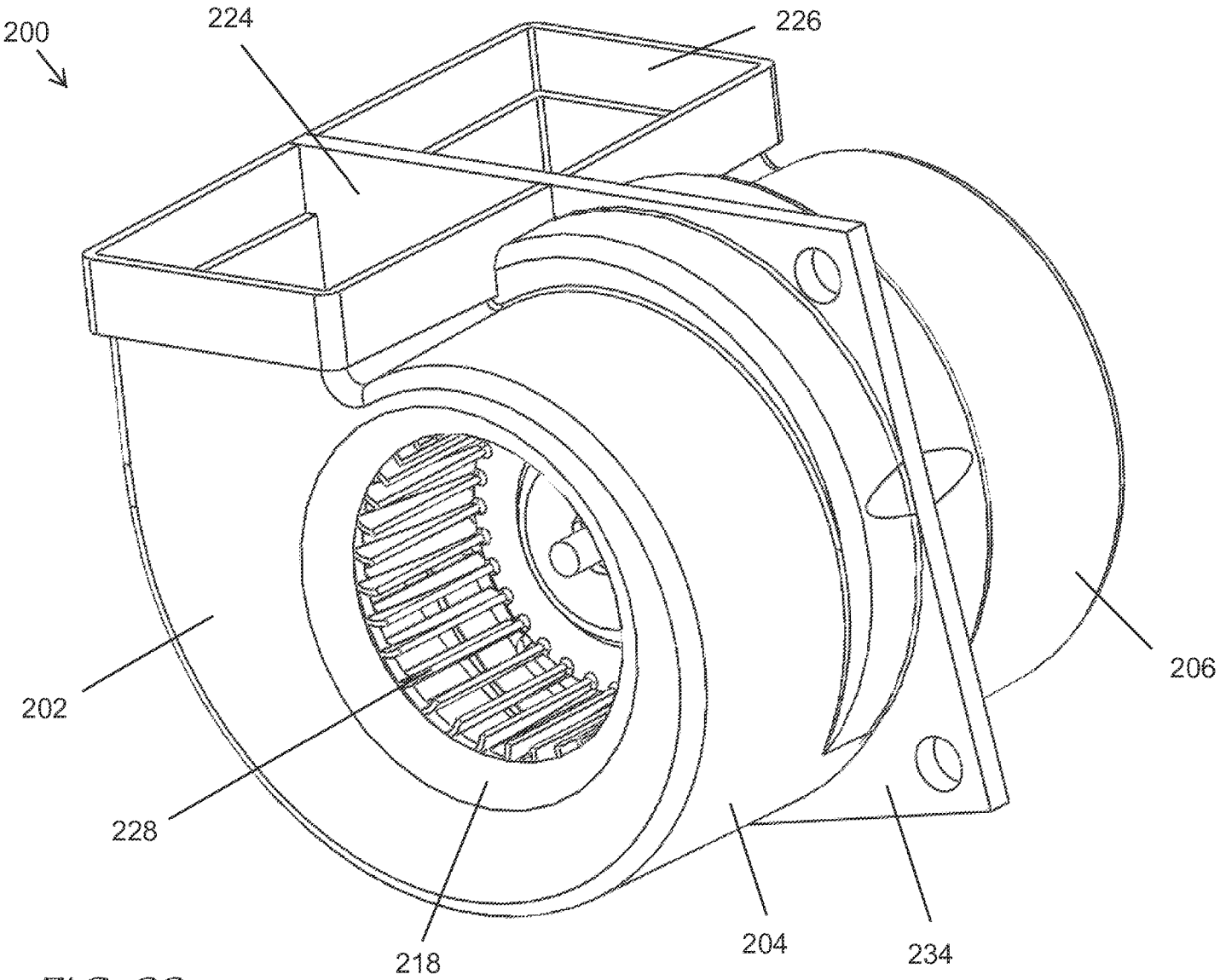
FIG. 22 is a front left perspective view of an embodiment of the centrifugal blower of the present invention.
Figure 23:
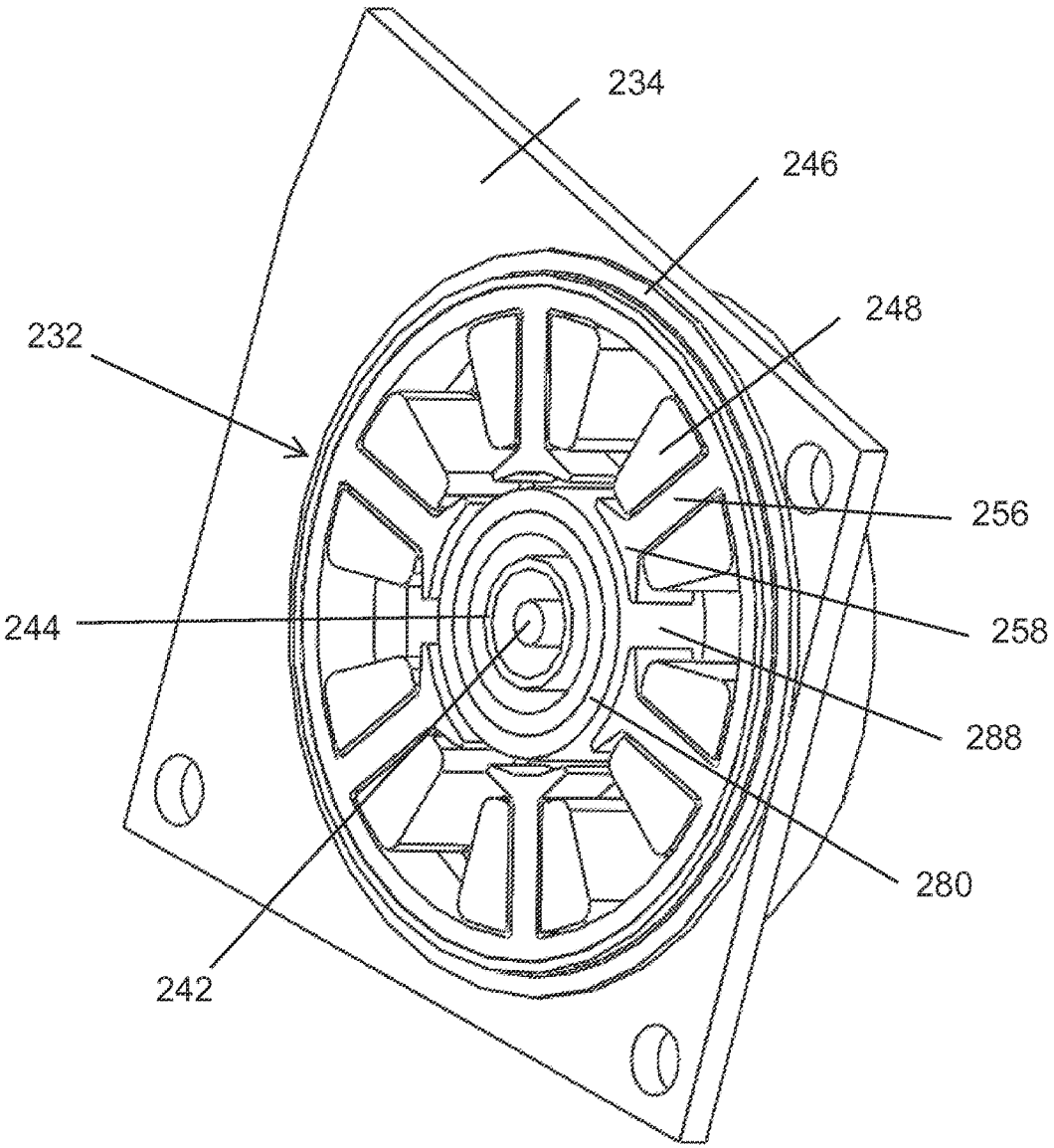
FIG. 23 is a front left perspective view of the motor and motor mount of the centrifugal blower of the type shown in FIG. 22.
Figure 24:
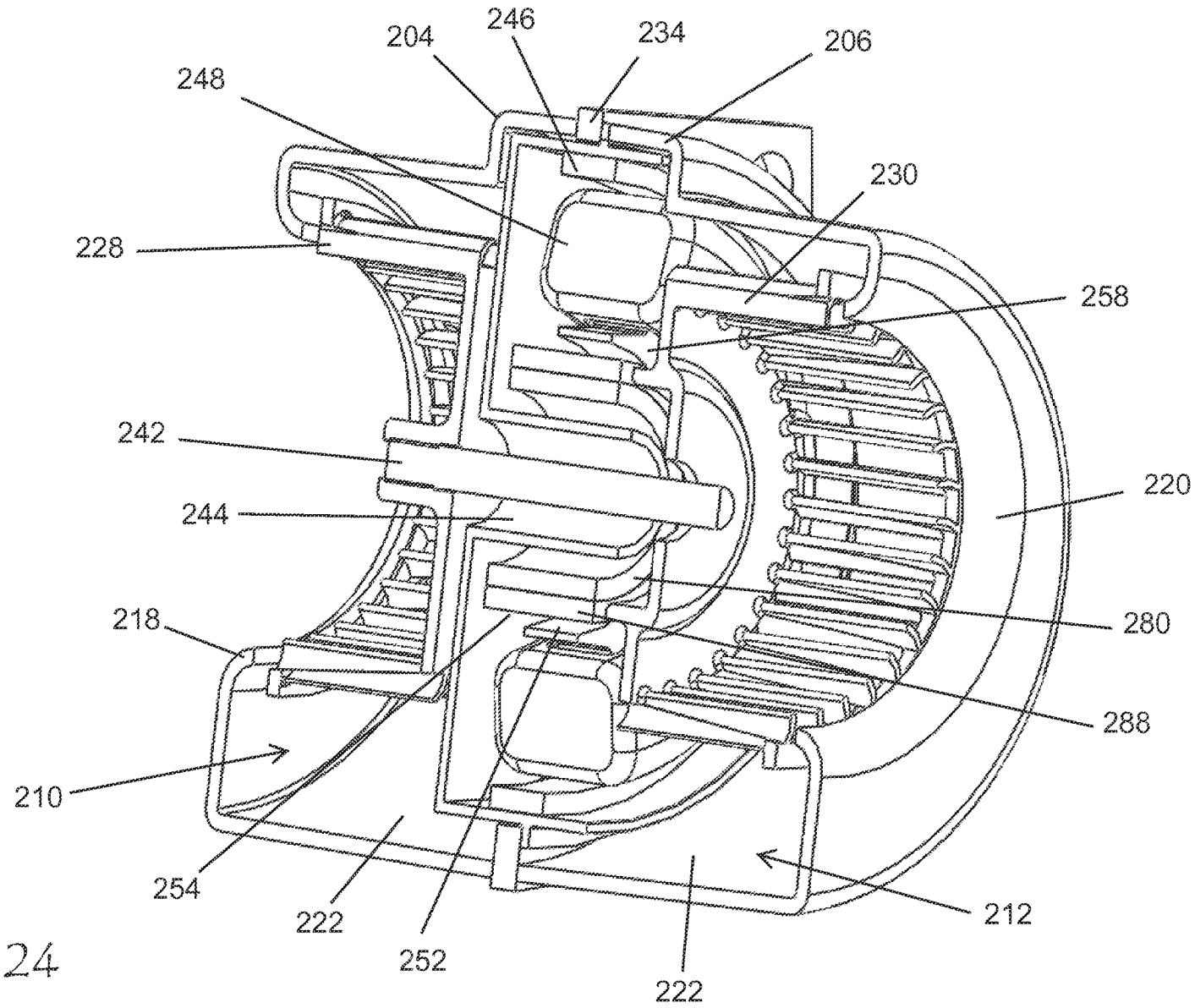
FIG. 24 is a partial sectional front right perspective view of the centrifugal blower of the type shown in FIG. 22.

An embodiment illustrated in FIGS. 22-24 shows centrifugal blower 200 having a housing 202 and a motor support PCBA 234. The motor support 234 extends through a mid-portion of the housing and divides the interior or blower chamber 222 of the housing into halves or sub-chambers 210 and 212. The first side 204 of the housing has an air inlet 218 forming an opening into the sub-chamber 210 and the second side 206 of the housing 202 has an air inlet 220 forming an opening into sub-chamber 212. First impeller 228 is positioned in sub-chamber 210 and second impeller 230 is positioned in sub-chamber 212. When the impellers 228 and 230 rotate air is drawn into the blower chamber 222 through respective air inlet openings. Airstreams flow into respective first and second air inlets 218 and 220, through the blower chamber 222 and exits out the housing 202 through air outlets 224 and 226.

Motor 232 rotates impellers 228 and 230 and is mounted to the motor support PCB 234 in a central aperture 236 extending through the motor support 234. Motor 232 includes the motor support adapter 246 that mounts and firmly engages the motor 232 to the motor support 234 in the central opening or aperture 236. Motor 232 generally includes rotor 280 and a stator. A hub 244 is attached or is formed integral with the adapter 246. Bearings (not shown in FIGS. 22-24) may be contained within hub 244 and are adapted to receive motor shaft or spindle 242. The spindle 242 extends through hub 244 and impellers 228 and 230 are mounted on opposing end portions of the spindle 242. The bearings allow the spindle and impellers to freely rotate within the corresponding sub-chambers 210 and 212. Rotor 280 is also affixed to the spindle 242 along a mid-portion of the spindle such that the rotor is aligned with the stator. The outer circumference of rotor 254 is slightly less that the inner circumference 252 of the ends 258 of the stator core 256 that are adjacent the magnetic rotor element 288 of the rotor 280. The stator may be aligned and engaged within stator pockets formed in the motor support adapter 246. The stator windings 248 wind about cores or insulators 256 and may be annularly arranged in stator pockets radially outwardly about magnetic rotor element 288.

Figure 25:
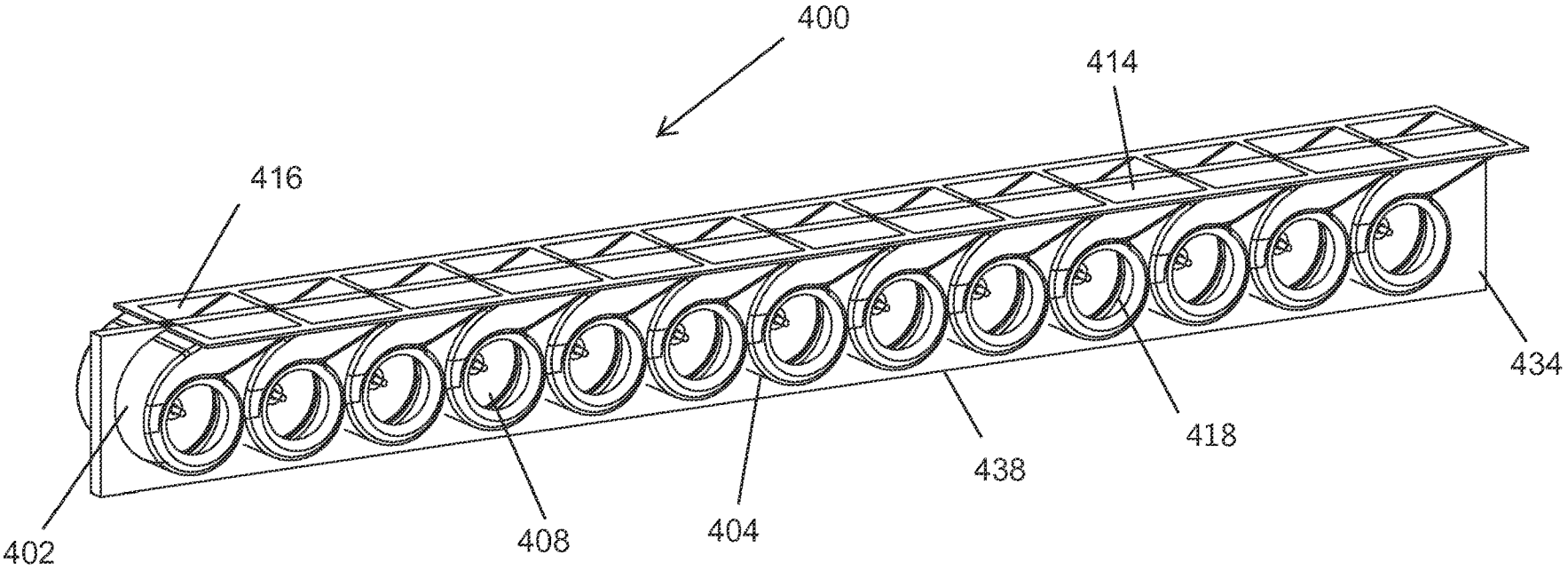
FIG. 25 is a back left perspective view of an embodiment of multiple centrifugal blowers of the present invention joined together with a common printed circuit board motor support frame.
Figure 26:
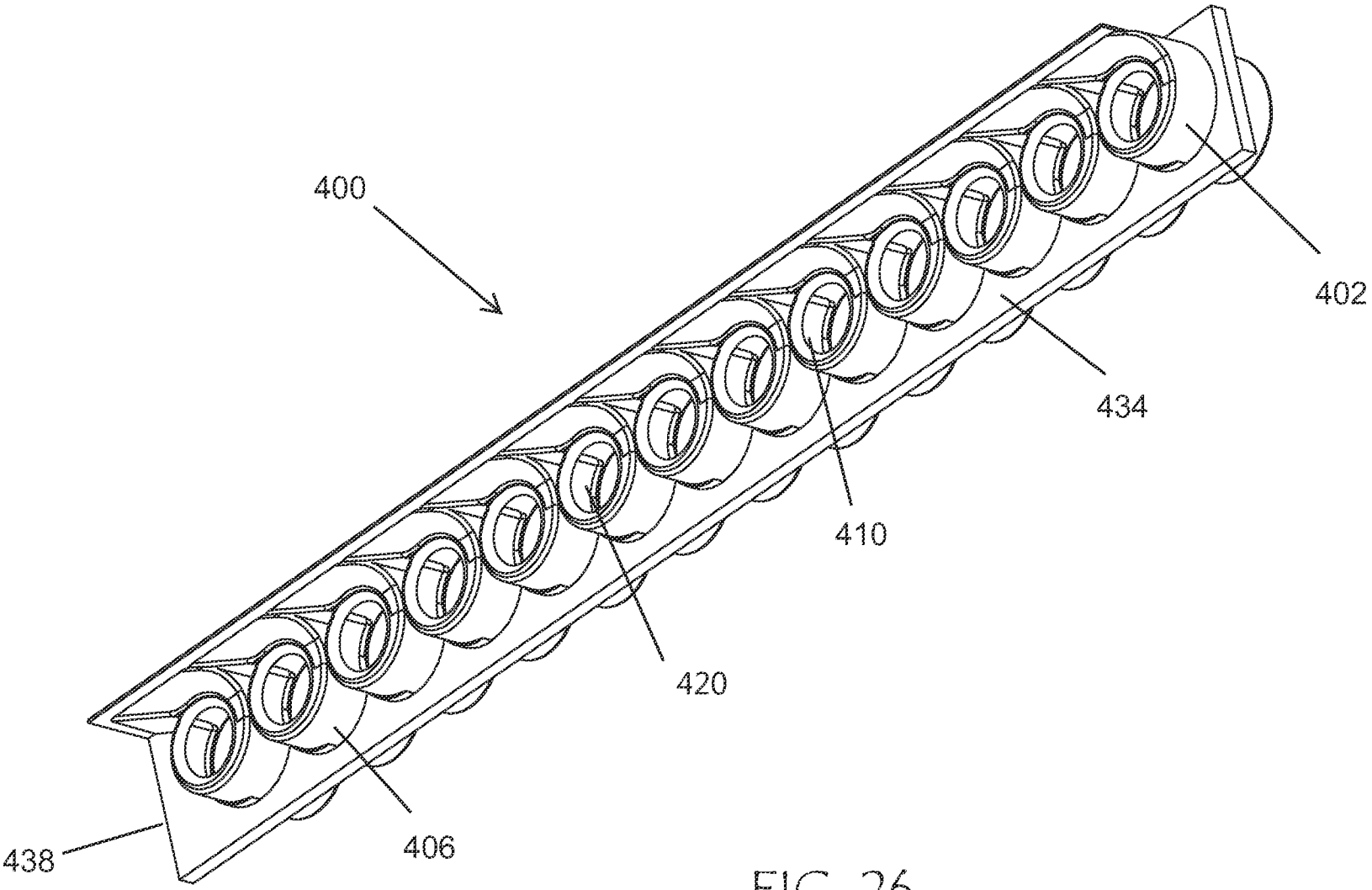
FIG. 26 is a back right perspective view of an embodiment of multiple centrifugal blowers of the present invention joined together with a common printed circuit board motor support frame.
Figure 27:
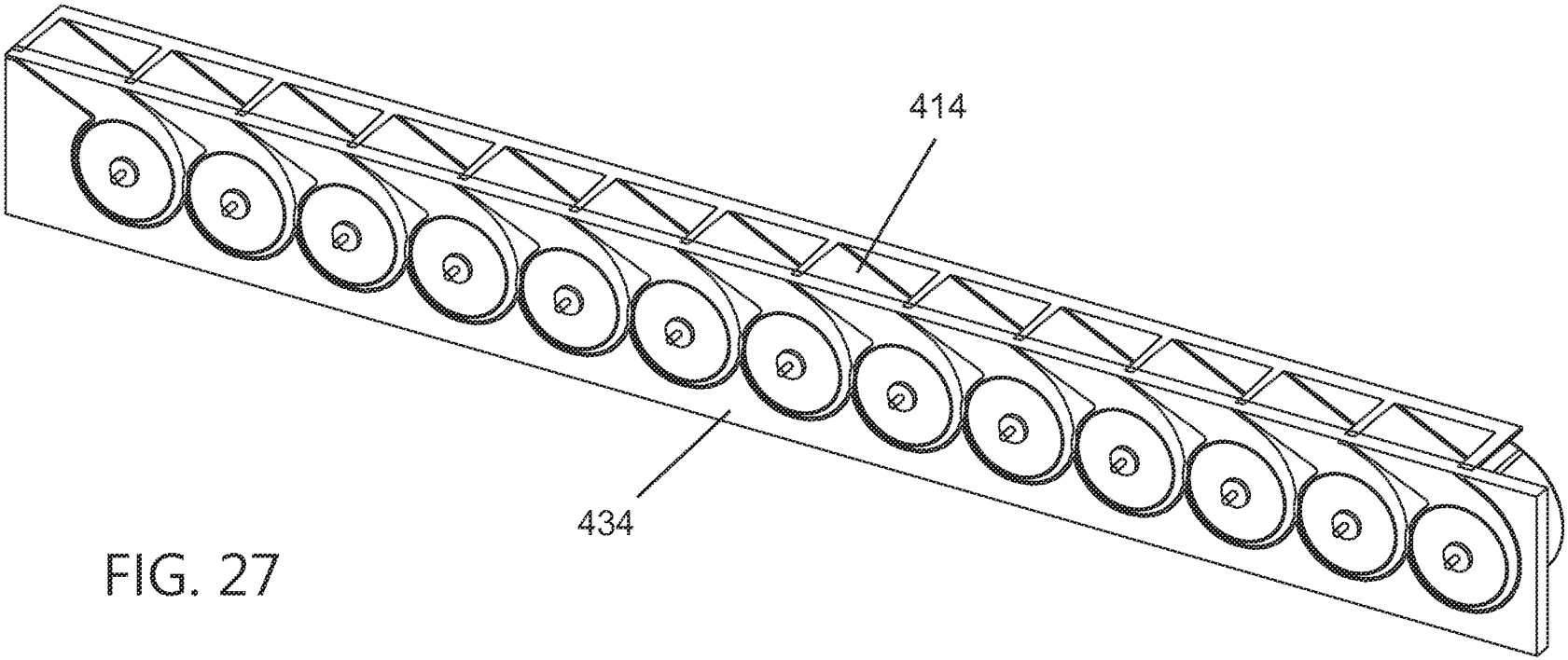
FIG. 27 is a back right perspective view of an embodiment of multiple centrifugal blowers of the type shown in FIG. 26 and showing the right blower housing and impeller removed.

The embodiment of the invention illustrated in FIGS. 25-27 shows a plurality of centrifugal blowers 400 generally having a construction as described herein but having a single motor support PCB 434 common to all the centrifugal blowers 400. The elongated PCBA 438 interconnects the blowers 400 and includes motor drive components and interconnecting traces to provide a single point of connection for both electrical power and motor control. The length and height of the PCBA 438 may be adapted to engage the interior sidewalls of a cooling module tray. Each centrifugal blower 400 has a housing 402 and motor support 434 extends through a mid-portion of each housing, dividing the interior of each blower into halves. The first side 404 of the housing has an air inlet 408 and the second side 406 of the housing 402 has an air inlet 410 forming an opening into the housing. First impeller 418 is positioned adjacent the first air inlet 408 and second impeller 420 is positioned adjacent the second air inlet 410. When the impellers 418 and 420 rotate air is drawn into the blower through respective air inlet openings. Airstreams flow into respective first and second air inlets 408 and 410, through the blower and exits out the housing 402 through air outlets 414 and 416.

These and various other aspects and features of the invention are described with the intent to be illustrative, and not restrictive. This invention has been described herein with detail in order to comply with the patent statutes and to provide those skilled in the art with information needed to apply the novel principles and to construct and use such specialized components as are required. It is to be understood, however, that the invention can be carried out by specifically different constructions, and that various modifications, both as to the construction and operating procedures, can be accomplished without departing from the scope of the invention. Further, in the appended claims, the transitional terms comprising and including are used in the open ended sense in that elements in addition to those enumerated may also be present. Other examples will be apparent to those of skill in the art upon reviewing this document.

The invention claimed is:

1. A centrifugal blower apparatus, comprising:

a housing having air inlets formed in opposing sides of said housing and having air outlets formed in an open end of said housing, wherein said air inlets and said air outlets are in fluid communication with a blower chamber within said housing;

a motor support that divides said blower chamber into at least a first and second sub-chamber, said motor support having at least one aperture formed through a central portion of said motor support, said at least one aperture being at least one of: circular or oval, said at least one aperture being adapted to receive a motor support sleeve, said motor support sleeve being at least one of: circular or oval, said motor support sleeve having an internal radial plane, said motor support being constructed, at least in part, of a printed circuit board assembly (PCBA);

a first impeller for motivating air positioned in said first sub-chamber;

a second impeller for motivating air positioned in said second sub-chamber;

a motor for rotating said first and second impellers, said motor having: a rotor and a stator mounted along said internal radial plane of, and substantially within, said motor support sleeve, such that an inner circumference of said stator is arranged concentrically radially about an outer circumference of said rotor, wherein the inner circumference of said stator is slightly larger than said outer circumference of said rotor, said PCBA including one or more components that control the motor; and a shaft, said shaft secured to said rotor via a first fastening device proximate to a first end of said shaft, said shaft secured to said second impeller via a second fastening device proximate to a second end of said shaft, wherein said first impeller is secured to at least part of said rotor via at least one of: a third fastening device or a structural integration.

2. The apparatus as recited in claim 1, wherein the motor is an electronically commutated direct current electric machine.

3. The apparatus as recited in claim 1, wherein a portion of said PCBA extends beyond an exterior of said housing.

4. The apparatus as recited in claim 1, further including multiple centrifugal blower apparatus interconnected together with said motor support, said motor support being common to all said multiple centrifugal blower apparatus.

5. The apparatus as recited in claim 4, wherein said apparatus includes multiple motors, each of said multiple motors being respectively associated with each of said multiple centrifugal blower apparatus.

6. The apparatus as recited in claim 5, wherein said one or more components of said PCBA includes one or more components that control all of said multiple motors.

7. The apparatus as recited in claim 5, wherein all of said multiple motors are electronically commutated direct current electric machines.

8. The apparatus as recited in claim 4, wherein each of said multiple centrifugal blower apparatus includes a respective shaft hub attached to said motor support, each said shaft hub having bearings to rotationally support each said shaft.

9. The apparatus as recited in claim 1, wherein said motor support is constructed of a material consisting of least one of: fiberglass, or metal.

10. The apparatus as recited in claim 1, wherein the one or more components of the PCBA comprise at least one of a group consisting of: a microprocessor, a transistor, a resistor, a diode, an electrical power connector, or a capacitor.

11. The apparatus as recited in claim 1, wherein said motor support sleeve includes a shaft hub having bearings to rotationally support said shaft.

12. The apparatus as recited in claim 1, wherein said stator is at least one from a group consisting of: glued, pressed, fastened, swaged, or staked to said motor support sleeve.

13. The apparatus as recited in claim 1, wherein said motor support sleeve comprises multiple stator pockets.

14. The apparatus as recited in claim 13, wherein said multiple stator pockets are arranged annularly and substantially within said motor support sleeve.

15. The apparatus as recited in claim 14, wherein said stator is aligned and engaged within said multiple stator pockets.

16. The apparatus as recited in claim 1, wherein said rotor is fixed to said shaft such that said rotor is aligned with said stator.

17. The apparatus as recited in claim 1, wherein said first fastening device is a hub collar.

18. The apparatus as recited in claim 1, wherein said second fastening device is a ring clamp.

19. The apparatus as recited in claim 1, wherein said third fastening device is a coupling bracket, and the at least part of said rotor is a rotor core, said coupling bracket being secured to said rotor core via at least one of: an adhesive or a weld.

20. The apparatus as recited in claim 1, wherein said first impeller, said second impeller, and said shaft rotate in unison with said rotor.

* * * * *